US006436620B1

(12) United States Patent
Aylward et al.

(10) Patent No.: US 6,436,620 B1
(45) Date of Patent: Aug. 20, 2002

(54) COLOR SWITCHABLE PHOTOGRAPHIC DISPLAY IMAGE

(75) Inventors: Peter T. Aylward, Hilton; Robert P. Bourdelais, Pittsford; Alphonse D. Camp, Rochester, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/844,007

(22) Filed: Apr. 27, 2001

(51) Int. Cl.[7] ..... G03C 1/46; G03C 1/785
(52) U.S. Cl. ..... 430/503; 430/359; 430/383
(58) Field of Search ..... 430/503, 383, 430/359

(56) References Cited

U.S. PATENT DOCUMENTS

| | | | | | |
|---|---|---|---|---|---|
| 4,705,745 | A | | 11/1987 | Kitchin et al. | 430/505 |
| 4,816,378 | A | | 3/1989 | Powers et al. | 430/301 |
| 5,639,580 | A | | 6/1997 | Morton | 430/11 |
| 5,679,139 | A | | 10/1997 | McInerney et al. | 106/20 D |
| 5,679,140 | A | | 10/1997 | McInerney et al. | 106/20 D |
| 5,679,141 | A | | 10/1997 | McInerney et al. | 106/20 D |
| 5,679,142 | A | | 10/1997 | McInerney et al. | 106/20 D |
| 5,689,372 | A | | 11/1997 | Morton | 359/623 |
| 5,737,087 | A | | 4/1998 | Morton et al. | 358/296 |
| 5,744,288 | A | * | 4/1998 | Buchanan et al. | 430/503 |
| 5,744,290 | A | * | 4/1998 | Szajewski et al. | 430/503 |
| 5,866,282 | A | | 2/1999 | Bourdelais et al. | 430/22 |
| 6,017,685 | A | | 1/2000 | Bourdelais et al. | 430/363 |
| 6,030,756 | A | | 2/2000 | Bourdelais et al. | 430/363 |
| 6,291,144 | B1 | * | 9/2001 | Aylward et al. | 430/359 |

FOREIGN PATENT DOCUMENTS

| | | |
|---|---|---|
| EP | 0 825 488 A1 | 2/1998 |
| EP | 0 915 374 A1 | 5/1999 |

* cited by examiner

*Primary Examiner*—Hoa Van Le
(74) *Attorney, Agent, or Firm*—Paul A. Leipold

(57) ABSTRACT

This invention relates to an imaging element comprising a translucent sheet, and at least three photosensitive dye forming coupler containing layers on the face side of said sheet, wherein said at least three photosensitive forming coupler containing layers comprise a cyan dye forming layer comprising a cyan dye forming coupler in combination with a red sensitized photosensitive emulsion, a yellow dye forming layer comprising a yellow dye forming coupler in combination with a blue light sensitive photosensitive emulsion, a magenta dye forming layer comprising a magenta dye forming coupler and a green light sensitive photosensitive emulsion, and on the back side of said translucent polymer sheet at least one dye forming coupler comprising magenta dye forming coupler, cyan dye forming coupler, or yellow dye forming coupler in combination with a light sensitive silver halide emulsion sensitive to a different wavelength of visible light than it was in combination with on the face side.

29 Claims, 3 Drawing Sheets

COLOR SWITCHABLE PHOTOGRAPHIC DISPLAY IMAGE

FIELD OF THE INVENTION

This invention relates to a silver halide image that varies in color depending on the viewing condition.

BACKGROUND OF THE INVENTION

It is known in the art that photographic display materials are utilized for advertising as well as decorative displays of photographic images. Since these display materials are used in advertising, the image quality of the display material is critical in expressing the quality message of the product or service being advertised. Further, a photographic display image needs to be high impact, as it attempts to draw consumer attention to the display material and the desired message being conveyed. Typical applications for display material include product and service advertising in public places such as airports, buses and sports stadiums, movie posters and fine art photography. The desired attributes of a quality, high impact photographic display material are a slight blue density minimum, durability, sharpness and flatness.

Further, prior art display material typically comprises a still image that is backside illuminated. It is widely known that the human eye is sensitive to motion and that the human eye and brain is attracted to motion and thus display materials integrating motion into an display is highly effective method for advertisement. Prior art motion displays typically consist of a series of still illuminated images that are scrolled back and forth on a take up roll.

Prior art silver halide display materials typically utilize yellow, magenta and cyan dyes to create an image. In a typical yellow, magenta and cyan imaging system the color gamut is limited and fixed once the image is exposed and developed. In order to change colors, another display would have to be generated and separately shown.

Bourdelais et al in U.S. Pat. No. 6,030,756 discusses imaging layers containing silver halide and dye forming couplers applied to both sides of a translucent base for a display material. While the display material in U.S. Pat. No. 6,030,756 provides an excellent image that can be displayed without the need for a backlight source, the image color is fixed. There remains a need in the display market to change the color appearance of the display without having to create a new display or to use expensive electronics devices.

McInerney et al in U.S. Pat. Nos. 5,679,139; 5,679,140; 5,679,141; and 5,679,142 teach the shape of preferred subtractive dye absorption shapes for use in four color, C,M,Y,K based ink-jet prints.

McInerney et al in EP 0 825 488 teaches the shape of preferred subtractive cyan dye absorption shape for use in silver halide based color prints.

Kitchin et al in U.S. Pat. No. 4,705,745 teaches the preparation of a photographic element for preparing half-tone color proofs comprising four separate imaging layers capable of producing cyan, magenta, yellow, and black images.

Powers et al in U.S. Pat. No. 4,816,378, teaches an imaging process for the preparation of color half-tone images that contain cyan, magenta, yellow, and black images. The use of the black dye does little to improve the gamut of color reproduction.

Haraga et al in EP 0 915 374 A1 teaches a method for improving image clarity by mixing 'invisible' information in the original scene with a color print and reproducing it as an infrared dye, magenta dye, or as a mixture of cyan magenta and yellow dyes to achieve improved color tone and realism. The addition of the resulting infrared, magenta, or black dye does little to improve the gamut.

In spite of the foregoing teachings, the coupler sets which have been employed in silver halide color imaging have not provided the ability to change color within the same imaging element. There remains a need to change color based on reflected or transmitted light. Viewing It has been proposed in U.S. Pat. No. 5,866,282 (Bourdelais et al) to utilize a composite support material with laminated biaxially oriented polyolefin sheets as a photographic imaging material. In U.S. Pat. No. 5,866,282, biaxially oriented polyolefin sheets are extrusion laminated to cellulose paper to create a support for silver halide imaging layers. The biaxially oriented sheets described in U.S. Pat. No. 5,866,282 have a microvoided layer in combination with coextruded layers that contain white pigments such as $TiO_2$ above and below the microvoided layer. In the composite imaging support structure described in U.S. Pat. No. 5,866,282 the silver halide imaging layers are applied to the white, reflecting side of the base that has a spectral transmission less than 15%.

Prior art photographic transmission display materials with incorporated diffusers have light sensitive silver halide emulsions coated directly onto a gelatin coated clear polyester sheet. Incorporated diffusers are necessary to diffuse the light source used to backlight transmission display materials. Without a diffuser, the light source would reduce the quality of the image. Typically, white pigments are coated in the bottom most layer of the imaging layers. Since light sensitive silver halide emulsions tend to be yellow because of the gelatin used, as a binder for photographic emulsions minimum density areas of a developed image will tend to appear yellow. A yellow white reduces the commercial value of a transmission display material because the image viewing public associates image quality with a whiter whites. It would be desirable if a transmission display material with an incorporated diffuser could have a more blue white since a white that is slightly blue is perceptually preferred as the whitest white.

Prior art photographic transmission display materials with incorporated diffusers have light sensitive silver halide emulsions coated directly onto a gelatin subbed clear polyester sheet. $TiO_2$ is added to the bottom most layer of the imaging layers to diffuse light so well that individual elements of the illuminating bulbs utilized are not visible to the observer of the displayed image. However, coating $TiO_2$ in the imaging layer causes manufacturing problems such as increased coating coverage which requires more coating machine drying and a reduction in coating machine productivity as the $TiO_2$ requires additional cleaning of coating machine. Further, as higher amounts of $TiO_2$ are used to diffuse high intensity backlighting systems, the $TiO_2$ coated in the bottom most imaging layer causes unacceptable light scattering reducing the quality of the transmission image. It would be desirable to eliminate the $TiO_2$ from the image layers while providing the necessary transmission properties and image quality properties.

It has been proposed in U.S. Pat. No. 6,017,685 (Bourdelais et al.) to utilize biaxially oriented polyolefin microvoided sheet laminated to polyester for a display base. In U.S. Pat. No. 6,017,685, the incorporated voided layer diffuses the illumination light source avoiding the problems with incorporated $TiO_2$ as a diffuser screen. Disclosed in U.S. Pat. No. 6,017,685 are yellow, magenta and cyan dyes formed by silver halide process and thus the silver halide image disclosed in U.S. Pat. No. 6,017,685 has a limited dye gamut compared to printed inks. Further, the display image disclosed in U.S. Pat. No. 6,017,685 is intended for a still image, one that is inserted into a light frame and projects a uniform, still image.

In has been proposed in U.S. Pat. Nos. 5,689,372; 5,737,087 and 5,639,580 to provide a reflective imaging member that provides motion. While these patents provide an image with a sense of motion they require the use of multiple image layers that have to critically aligned with each other in the presence of a lenticular screen. The motion is generated as the print material is viewed from various angles. While these images provide both depth and motion, they are very expensive to produce and require great skill to properly align the multiple images. There remains a need to for an imaging element that can provide a sense of motion or change in the image without the expense or high level of skill required aligning multiple images.

PROBLEM TO BE SOLVED BY THE INVENTION

There is a need for a display imaging material that provides a sense of motion and is capable of changing color.

SUMMARY OF THE INVENTION

It is an object of the invention to provide improved imaging layers.

It is another object to provide imaging material that can switch color based on illumination.

It is a further object to maintain processing efficiency of the silver halide image.

It is another object to provide more efficient use of the light used to illuminate transmission display materials.

It is a further object to provide an image with motion.

These and other objects of the invention are accomplished by an imaging element comprising a translucent sheet, and at least three photosensitive dye forming coupler containing layers on the face side of said sheet, wherein said at least three photosensitive forming coupler containing layers comprise a cyan dye forming layer comprising a cyan dye forming coupler in combination with a red sensitized photosensitive emulsion, a yellow dye forming layer comprising a yellow dye forming coupler in combination with a blue light sensitive photosensitive emulsion, a magenta dye forming layer comprising a magenta dye forming coupler and a green light sensitive photosensitive emulsion, and on the back side of said translucent polymer sheet at least one dye forming coupler comprising magenta dye forming coupler, cyan dye forming coupler, or yellow dye forming coupler in combination with a light sensitive silver halide emulsion sensitive to a different wavelength of visible light than it was in combination with on the face side.

ADVANTAGEOUS EFFECT OF THE INVENTION

The invention provides a display motion imaging material that is color switching capable while maintaining typical the 45-second color development time.

DETAILED DESCRIPTION OF THE INVENTION

Figure 1:
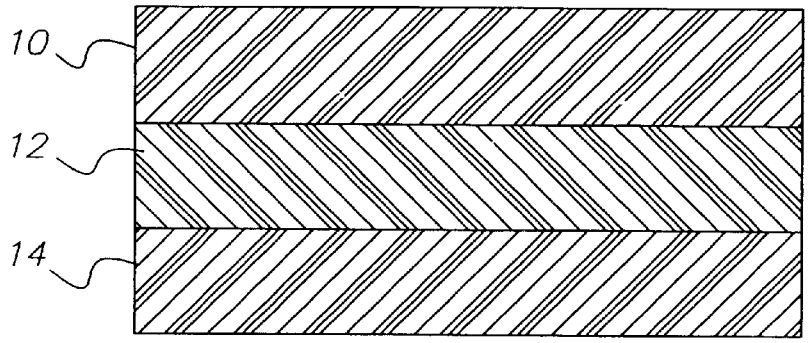
FIG. 1 is a drawing of the basic imaging material with duplitized emulsion

The invention has numerous advantages over prior practices in the art. The photographic element of the invention provides a sense of motion to a still photographic image that is more effective at gaining the attention of consumers than still images. The invention material utilizes common back lighting technology currently available in the trade as the color switching, which provides the illusion of motion, is incorporated into the photographic element. This invention, for example, allows for a facial image to "wink" at consumers as they pass by the display image. The switchable silver halide image of the invention is preferred over electronic display that contains motion because typical electronic displays does not have a wide viewing angle compared to silver halide images and ambient light significantly reduces the quality of the electronic image as back light sources for electronic display materials is often weaker that ambient light sources.

The photographic element of the invention employs subtractive, additive, or a combination of subtractive and additive color imaging. In such imaging, a viewable digital print color image is formed by generating a combination of cyan, magenta, yellow on one side of a photographic element while on the other side the same light forms a different color because a different dye forming coupler is in a different light sensitive layer than that on the face side. In this element when light of a specific wavelength is used to expose a light sensitive layer of that wavelength, it will form different color on the front then on the backside. Since the translucent sheet used in this invention is both reflective and diffusive, the photographic element will only show the front or top color in reflected light but will show a different color in transmitted light. That is the colors are additive. If the light source is varied or turned on and off the color will change to the viewer. The object is to provide a reproduction that is pleasing to the observer, but also has switchable color capable depending if it is viewed by reflected light or by transmitted light source. Color in the reproduced image is composed of one or a combination of the cyan, magenta and yellow image colorants. The relationship of the original color to the reproduced color is a combination of many factors. It is, however, limited by the color gamut achievable by the multitude of combinations of cyan, magenta, yellow colorants used to generate the final image.

In addition to the individual colorant characteristics, it is necessary to have cyan, magenta and yellow that have preferred absorption maxima relative to one another and that have absorption band shapes which function together to provide an optimum overall color gamut. The imaging element of the invention can be processed in 45 seconds, as the additional dyes and couplers required for color switching are applied to the back side of the transparent polymer sheet as separate emulsion layer. The processing time is shorter than most display materials in which a double coverage of emulsion is placed on one side.

The developed silver halide imaging element with switchable color is applied to a variety of support materials containing an incorporated diffuser thus allowing silver halide images with switchable color to be utilized for illuminated display. The base materials useful in this invention allow a greater amount of illuminating light to actually be utilized for display illumination because they have both light reflecting and diffusing characteristics with minimal scattering or absorption. The display material of the invention will appear whiter to the observer than prior art materials because they use voided or foamed polymer layers that do not add unwanted color. Additional they may also use bluing tints and optical brighteners that make the white appear whiter. Prior art materials typically use high levels of pigment to provide opacity or diffusion. These high concentrations of pigments appear yellow to the observer and result in an image that is darker than desirable. These and other advantages will be apparent from the detailed description below. The imaging element of this invention is illustrated by FIG. 1 which depicts a cross section of the preferred duplitized color switchable imaging material with the face image layers 10 and the translucent sheet 12 and the backside image layers 14. While not noted in this figure, the dye forming coupler in the face side image layer is in a different light sensitive than those of the backside image layer.

For the preferred imaging element embodiment of the invention, the imaging element comprises a translucent sheet, and at least three photosensitive dye forming coupler containing layers on the face side of said sheet, wherein said at least three photosensitive forming coupler containing layers comprise a cyan dye forming layer comprising a cyan dye forming coupler in combination with a red sensitized photosensitive emulsion, a yellow dye forming layer comprising a yellow dye forming coupler in combination with a blue light sensitive photosensitive emulsion, a magenta dye forming layer comprising a magenta dye forming coupler and a green light sensitive photosensitive emulsion. On the back side of said translucent polymer sheet at least one dye forming coupler comprising magenta dye forming coupler, cyan dye forming coupler, or yellow dye forming coupler in combination with a light sensitive silver halide emulsion sensitive to a different wavelength of visible light than it was in combination with on the face side is preferred.

The basic principle of color reproduction is derived from what the eye perceives. By combining three colors it is possible to match all visible color. By superimposing different dyes on each other, it is possible to provide a full gamut of color. Using this basic principle together with a duplitized front and back side photographic emulsion set and a reflecting and diffusive base, it is possible to change the color appearance of an image depending whether it is viewed by reflection or by transmission. As describe above for a given color sensitive silver halide layer, there is a different dye forming coupler on the front then is on the back. A single source of light provides a different color forming dye on the top than on the bottom. In reflected light only the top color is observed but when viewed by transmission there is a combination of the top and bottom different colors that creates a third color perception. Therefore the observed color switches depending on the source of illumination.

Table 1 below provides some of the possible combinations of color dye on the top and bottom side of a reflective and diffusive base.

TABLE 1

| Top Side | | | | Bottom Side | | |
|---|---|---|---|---|---|---|
| Top Side light sensitive layer | Dye Forming Coupler | Color Observed by reflected light | /Base / Reflective/ Diffusive Base | Bottom Side light Sensitive Layer | Dye Forming Coupler | Color Observed by transmitted Light |
| Red | Cyan | Cyan | | Red | Yellow | Green |
| Red | Cyan | Cyan | | Red | Magenta | Blue |
| Red | Magenta | Magenta | | Red | Yellow | Orange |
| Green | Magenta | Magenta | | Green | Yellow | Orange |
| Green | Magenta | Magenta | | Green | Cyan | Blue |
| Green | Yellow | Yellow | | Green | Cyan | Green |
| Blue | Yellow | Yellow | | Blue | magenta | Orange |
| Blue | Yellow | Yellow | | Blue | Cyan | Green |
| Blue | Magenta | Magenta | | Blue | Cyan | Blue |

As can be seen in Table 1, when light is used to expose a certain color layer simultaneously on the top and bottom side of a duplitized imaging member and there is a different dye forming coupler on the top than is on the bottom different color can be produced. This table is not intended to provide a complete combination of every color combination but to illustrate the basic concept of a swtitchable photographic display. While not shown in the above table, it is possible to blend two couplers within a given light sensitive layer on one side of the duplitized imaging member. This provides an extended color range that can be observed.

Figure 2:
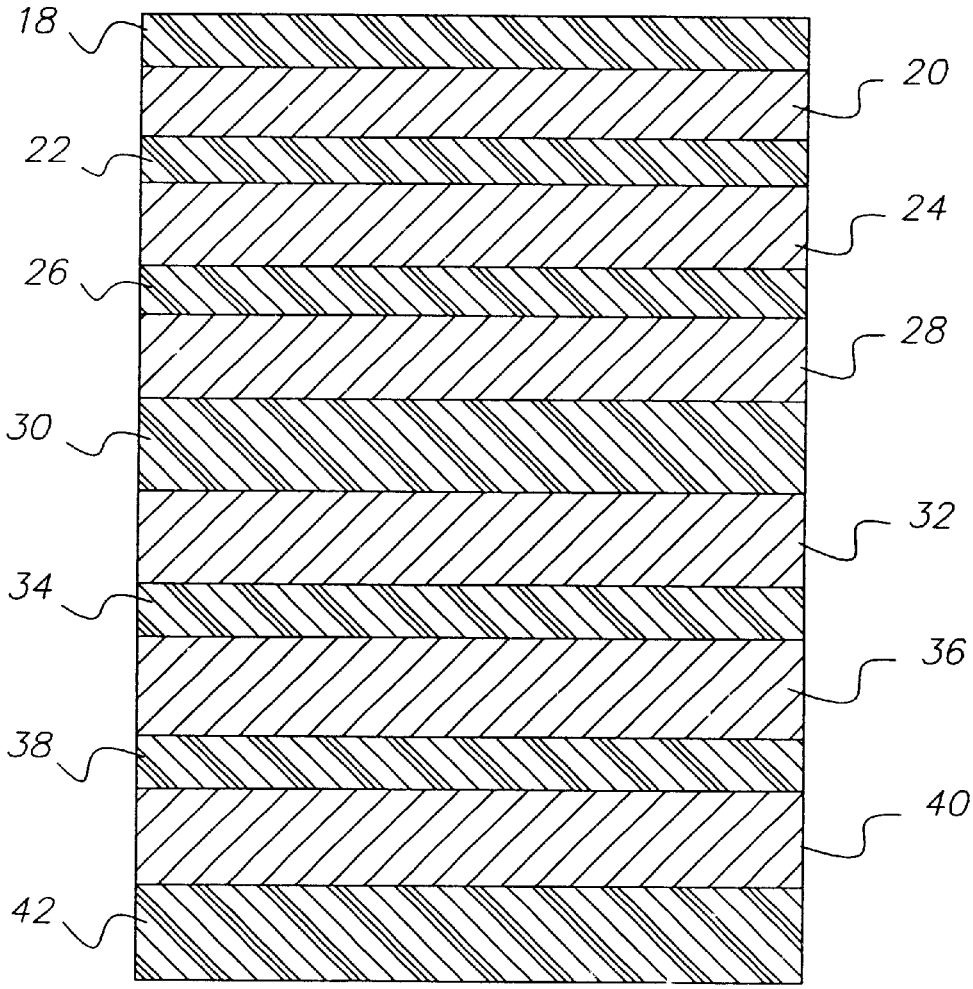
FIG. 2 is a drawing of the imaging material with switchable color

The preferred method of creating a switchable photographic image as describe in the above preferred embodiment additional requires that the images layer are exposed, the image is developed and the developed imaging element is placed with a spaced separation from the light source and the light source may be varied in intensity. For the purpose of this invention varying the light source intensity also includes turning the light on and off. By providing a light sensitive silver halide emulsion in combination with a different dye forming coupler sensitive to a different wave length of light on the back side of the imaging element than it was in combination on the face side, the silver halide image of the invention contains two images that can be switched by modulation of the illumination light source or by the addition or subtraction of light of a color other than white light. Illustrated by FIG. 2 is the preferred embodiment of this invention which employs recording elements that are constructed to contain at least three silver halide emulsion layer units. Also it is noted that there is a silver halide-recording element on each side of the translucent sheet. FIG. 2 depicts a size overcoat 18, a red-sensitized, cyan dye image-forming silver halide emulsion layer 20 that is situated furthest from the translucent polymer sheet 30.

Next in order is an interlayer 22 ontop of the green-sensitized, magenta dye image-forming layer 24, followed by another interlayer 26 and the upper blue-sensitized, yellow dye image-forming layer 28. The image-forming units are separated from each other by hydrophilic colloid interlayers 22 and 26 containing an oxidized developing agent scavenger to prevent color contamination. Ultraviolet light absorbing materials may also be added to these layers. These layers are on the upper side of the translucent polymer sheet 30. On the bottom or lower side of translucent polymer sheet 30 is a red sensitized, magenta dye forming silver halide layer 32 and below that an interlayer 34. Next there is a green sensitive, yellow dye forming coupler silver halide layer 36 and another interlayer 38 and below that a blue sensitive, cyan dye forming silver halide layer 40. The bottom most layer is a size overcoat 42. In addition to providing protection for the bottom light sensitive layers, the overcoat 42 may also comprise a white pigment and or anithalation dyes.

The front image is separated from the back image using a translucent sheet such that utilizing reflected light only; an observer can only see the front image. When the switchable image is viewed in transmission, the back image is combined with the front image to provide a complimentary image that provides a sense of motion and a change in color. In an embodiment of this invention an imaging element and the method of creating a switchable photographic element comprises a translucent sheet, at least three photosensitive dye forming coupler containing on the face side of the translucent sheet, wherein said at least three photosensitive forming dye coupler containing layers comprises a cyan forming layer comprising a cyan dye forming coupler in combination with a red sensitized photosensitive emulsion, a yellow dye forming layer comprising a yellow dye forming coupler in combination with a blue light sensitive photosensitive emulsion, a magenta dye forming layer comprising a magenta dye forming coupler and a green light sensitive photosensitive emulsion, and on the back side said back side comprises a layer comprising cyan dye forming coupler in combination with an emulsion sensitive to blue light. Furthermore it should be noted that the above embodiment may be developed and placed with a separation from a light source and the light source varied in intensity. Said embodiment is preferred because when blue light exposes the face side emulsion yellow dye is formed and on the backside the same blue light forms cyan dye. When said imaging element is viewed in reflected light only, yellow is seen. When the backlights are turned on, cyan dye is seen in combination with the yellow dye to form green. By modulating the transmitted light source, the color changes. This is very eye catching and draws people attention to the image. The ability to catch people's attention is very important in the commercial display and advertising area. It is also very important in education, where it is critical to hold the attention of school children.

In a preferred embodiment of said imaging element wherein said at least three photosensitive dye forming coupler containing layers on the face side of said translucent polymer sheet has a photographic speed that is different than said at least one dye forming coupler on the back of said transparent polymer sheet. Having a different speed in the front side light sensitive layers than that on the backside helps to provide an image that is pleasing in either reflection lighting conditions as well as in transmitted lighting conditions. Because the base element is translucent it tends to absorb some light and is therefore desirable to have the backside light sensitive layers slightly faster than the front side light sensitive layers such that exposure provides approximately equal densities on each side.

In an additional preferred embodiment said three photosensitive forming coupler containing layers on the face side of said imaging element are combined with a backside photosensitive layer of cyan dye forming coupler in combination with an emulsion sensitive to green light. This embodiment is preferred because it provides a different color on the face versus the backside such that the color appearance is different in reflected light as opposed to transmitted light. The method of creating a switchable photographic element requires the developing of the image and placing it in a light box in which there is a separation from a varying intensity light source. This is very useful in drawing attention to the image.

In further embodiments of this invention the above described three photosensitive dye forming couplers on the face side of said translucent polymer sheet are in combination with a backside photosensitive emulsion wherein the magenta dye forming coupler is combined with an emulsion sensitive to blue light or in a different embodiment where the backside magenta dye forming coupler is combined with an emulsion sensitive to red light. The photographic image is developed and placed in a light box with a separation from the light source forms a different color on the backside from that of the face side, therefore allowing for a switchable color appearance simply by turning the transmitted light source on and off or varying the intensity.

Other preferred embodiments and methods of forming a switchable imaging element of this invention include a three photosensitive dye forming coupler on the face side of said translucent polymer sheet wherein the backside emulsion comprises a yellow dye forming coupler in combination with a green light sensitive emulsion or a red light sensitive emulsion. These combinations are preferred because it provides one color on the face side and a different color on the backside in each of the respective green light sensitive emulsions. By developing the image and placing the image with a space from the light source, the color appearance changes from reflected light viewing versus transmitted light viewing. Reflected light viewing and transmitted viewing can be changed by varying the intensity of the backlight.

In a most preferred embodiment of this invention said imaging element comprises a translucent sheet wherein said back side comprises the three photosensitive dye forming coupler containing layers on the face side in combination with a sensitized emulsion of a different color sensitivity than of the three couplers in combination on the face side. This embodiment is preferred because it provides complete flexibility of forming different dye on the backside than formed on the face side. In this embodiment at least three colors can be switched. Being able to change the entire color appearance of this photographic element provides a much larger impact on the viewer. In an additional embodiment of the above most preferred embodiment, the method of creating a switchable photographic further comprises the developing of the image and the placement of the image at a spaced separation from a light source and the light source is controlled such that the intensity varies. The translucent sheet used in this or any of the above embodiments suitably has a spectral transmission of between 40 and 60 percent. The translucent sheet may further comprise voids and may even further comprise an antistat.

Further, by applying at least one of the photosensitive dye forming coupler containing layers on the opposite side of the translucent support, during the processing step of image creation, the additional layer of the invention is in contact with the development chemistry, thereby allowing for 45 second development time.

The at least three photosensitive dye forming coupler containing layers on the face and the back side with switchable color are adhered to a translucent sheet that has a spectral transmission between 35 and 65 percent. A spectral transmission of the translucent sheet between 35 and 65 percent has been found to provide diffusion of back light sources and allow enough light energy to reach the observer's eye. Below 30 percent transmission, not enough light energy reaches the observer's eye to provide a quality image. Above 70 percent transmission, the back lighting source can be seen in the image, reducing the quality of the transmission image. The most preferred imaging element has a spectral transmission between 40 and 60 percent. It has been found that this range provides adequate diffusion to prevent the lights from showing through the imaging element. The said translucent polymer sheet of this invention may comprise at least one white pigment layer and or at least one voided layer. This is preferred because it provides a sheet that has good reflective qualities for reflected light viewing and excellent diffusive qualities for transmitted viewing while minimizing light scattering. Said white pigment layer may be above the voids to create a normal viewing print or it may be below the voided layer to create a nacreous appearance when the image is viewed by reflected light. In a further embodiment said translucent sheet may further comprise optical brightener to make whites appear whiter and tinting aid that may be used to make D-min white appear to be blue white. This is desirable in photographic systems to compensate for the yellowness of gelatin that is used in photographic light sensitive emulsions. When applying gelatin to polymer substrates, it is desirable to have an adhesion-promoting layer. In a further preferred embodiment of this invention said translucent polymer sheet comprises an adhesion-promoting layer. Said adhesion-promoting layer may comprise polyethylene or copolymer thereof or a primer layer with a gel subbing layer. Polyethylene is preferred because it has good wettability of the emulsion during coating and it has excellent pre and post process adhesion. Said preferred translucent sheets that are embodied in this invention may be coextruded as one integral sheet with individual layers. The most preferred embodiment of a coextruded translucent polymer sheet is polyester.

Polyester is preferred because it is high in stiffness and resists core set curl when rolled in a tube. The integrally formed translucent sheet are preferred because they can be formed in a single manufacturing operation and provide excellent diffusion for back lighting as well as good reflection for reflected light viewing. Said translucent sheet may also be formed by laminating a biaxially oriented sheet of polyolefin which further comprises a white pigment layer and a voided layer by adhesivley adhering it to a sheet of polymer such as polyolefin, polyester, polycarbonate or other suitable polymer sheet as well as to a translucent paper substrate. The laminated embodiment is preferred because a thin reflected diffusion screen can be adhesively laminated to a clear support for added stiffness. U.S. Pat. Nos. 6,017,685; 6,030,756 and 6,063,552 provide addition details of polyolefin sheets laminated to polyester sheets to form a reflective and diffusive translucent sheet. This means of forming a translucent sheet provides added flexibility to the choice of diffusion screens by being able to use a variety of substrates. The translucent polymer sheets in this invention may also further comprise an antistat layer. When working with photographic layers prior to exposure, it is important to have a conductive layer to prevent static buildup and discharge.

In an embodiment of this invention said translucent sheet may comprise translucent cellulose fiber. A translucent cellulose sheet is preferred because it provides a cheap means of producing a translucent sheet that holds the face and the back side emulsions.

Figure 3:
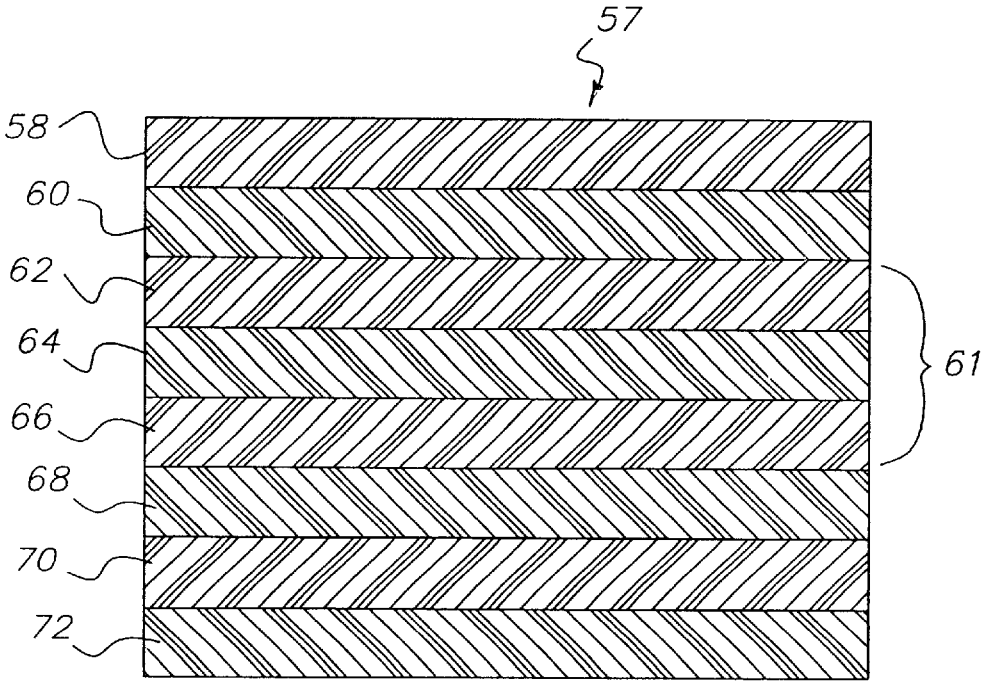
FIG. 3 is a preferred translucent polymer sheet
Figure 4:
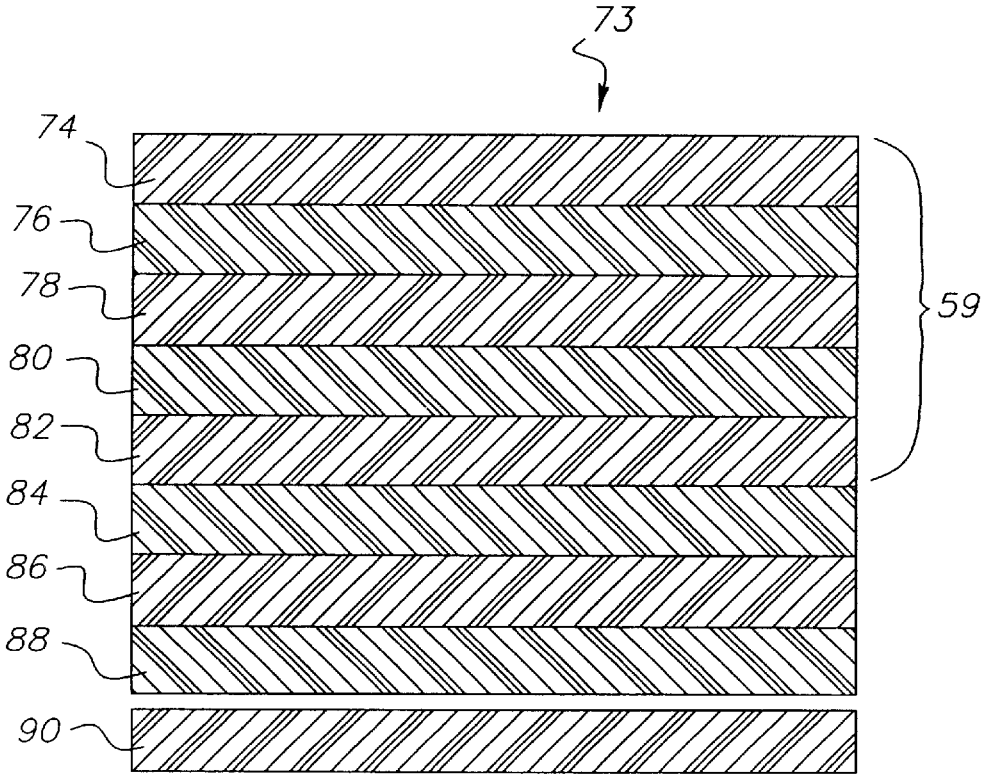
FIG. 4 is another preferred translucent polymer sheet

Illustrated by FIGS. 3 and 4 are a detailed description of the translucent polymer sheets that may be used as the base for the imaging member of the invention. FIG. 3 is a preferred translucent polymer base and comprises a top gel sub layer 58 that aids in adhesion of the silver halide emulsion, a primer layer 60 that promotes adhesion to the polyester sheet 61. The polyester sheet 61 comprises a pigmented filled layer 62 that aids in reflection viewing of the top image, a voided polyester layer 64 that provides diffusion when the image is backlite, a clear polyester layer 66 for added support and stiffness. There is also a bottom side primer layer 68 and an antistatic layer 70 that helps to minimize static charge acculmation. Additionally a gel sub layer 72 may be applied adjacent to antistat layer. This may be necessary to enhance the adhesion of this layer to the bottom emulsion layers.

Another preferred translucent polymer sheet 73 that may be used in this invention is illustrated by FIG. 4. This figure represents a biaxially oriented polymer sheet 59 that is laminated to a sheet of polyester 86, wherein the top most layer 74 is a layer of polyethylene that may further comprise tints which is on top of a white pigmented layer of polypropylene 76 that may also contains optical brightener. Layers 74 and 76 are on top of a voided layer of polymer 78 and clear layers of polypropylene 80 and 82. Layer 84 is an adhesive tie layer and may be either a melt polymer such as polyethylene or a solvent based adhesive that attaches the above described layers to a clear sheet of polyester 86 that helps to provide additional stiffness. Additionally polyester sheet 86 comprises a primer layer 88 and an antistat layer 90.

Figure 5:
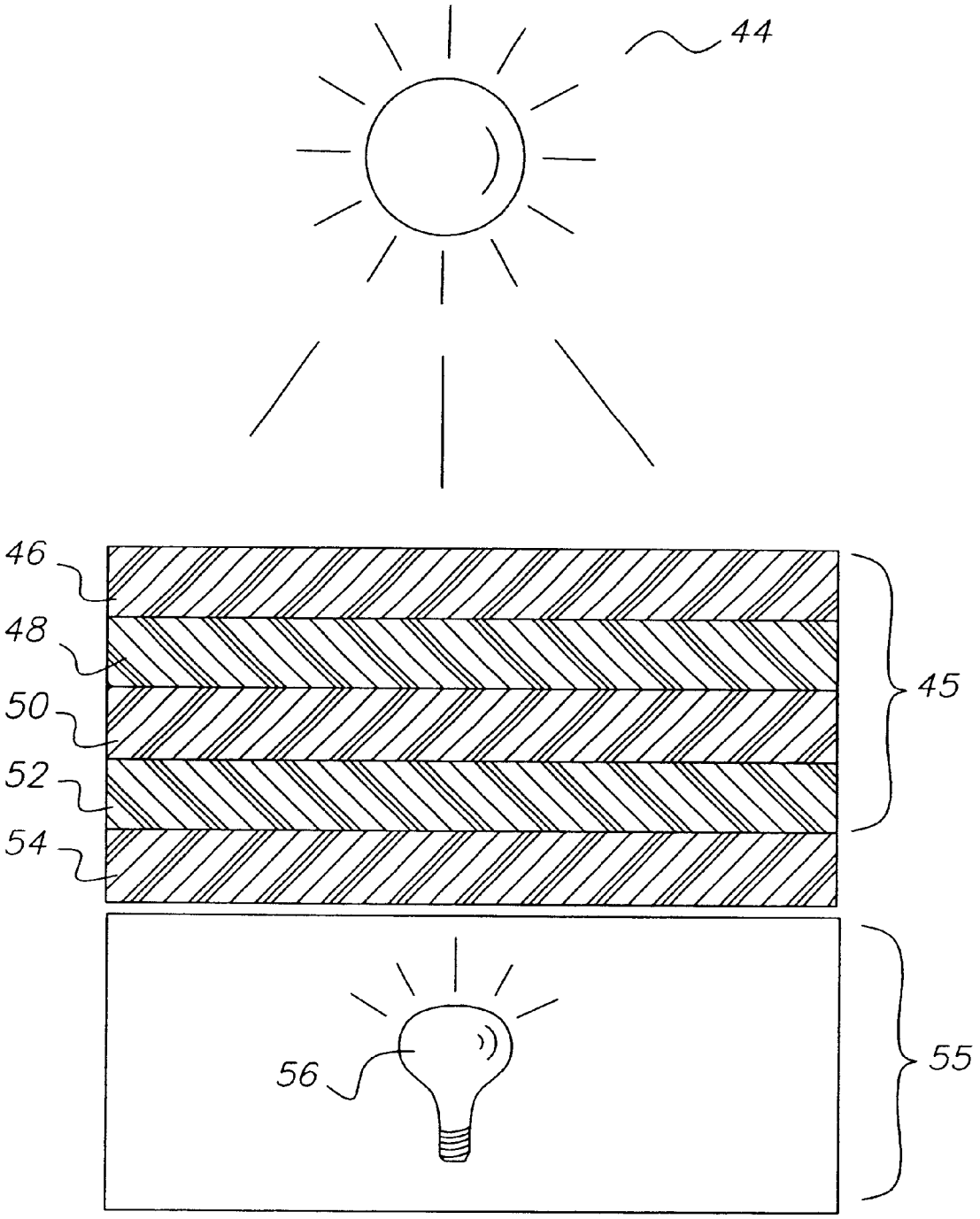
FIG. 5 is an imaged switchable imaging element and a display display device with a modulating light source

FIG. 5 illustrates a display device consisting of the color switchable imaging element 45 of this invention that has been imaged and developed which consists of the top or face side emulsion 48, a translucent polymer sheet 50, and a bottom or backside emulsion 52. The color switchable imaging element 45 is placed in a light display device 55 that comprises a clear top cover 46, a clear plastic or glass bottom cover 54 and a light box 55 with modulation light 56. The light 56 may be varied in intensity or turned on and off Normal reflection viewing is achieved when light source 44 is on and the back light 56 is off. Since the individual light sensitive layer on top have a different dye forming coupler than those on the back, one color will be observed when the light 44 is on and 56 is off. Since the backside emulsion 52 has a different dye couple than those of the face side 48, when light 56 is turned on, an observer from the front side will see a shift in color.

For the silver halide display materials with a switchable color photographic image, the layers of the biaxially oriented polymer sheet have levels of microvoiding, $TiO_2$ and colorants adjusted to provide optimum light transmission properties. The functional optical properties for the transmission display materials have been incorporated into the polymer sheet. Microvoiding the polymer sheet in combination with low levels of $TiO_2$ provide a very effective diffuser of backlighting sources that are used to illuminate switchable color photographic image. Colorants and optical brightener are added to the polymer sheet of this invention to offset the native yellowness of the photographic imaging layers. The polymer sheet of the invention may be laminated to a transparent polymer base for stiffness for efficient image processing as well as product handling and display.

The translucent polymer sheet of the invention preferably has an optical transmission greater than 40%, as the light sensitive silver halide imaging layers applied to both sides of the transparent polymer sheet are exposed simultaneously. The term as used herein, "transparent" means the ability to pass radiation without significant deviation or absorption. For this invention, "transparent" material is defined as a material that has a spectral transmission greater than 90%. For a photographic element, spectral transmission is the ratio of the transmitted power to the incident power and is expressed as a percentage as follows; $T_{RGB}=10^{-D}*100$ where D is the average of the red, green and blue Status A transmission density response measured by an X-Rite model 310 (or comparable) photographic transmission densitometer. The term "translucent" means the ability to diffusively pass some radiation with little or no scattering. The preferred range is between 35 and 65% transmission. The term as used herein; "duplitized" element means elements with light sensitive silver halide coating on the topside and the bottom side of the imaging support.

A biaxially oriented transparent polymer sheet is preferred as biaxial orientation of a polymer increases the toughness and the ability to carry the light sensitive silver halide imaging layers though manufacturing and the imaging development process. Biaxially oriented polymer bases are conveniently manufactured by coextrusion of the base, which may contain several layers, followed by biaxial orientation. Such biaxially oriented bases are disclosed in, for example, U.S. Pat. Nos. 4,764,425 and 5,866,282.

Suitable classes of thermoplastic polymers for the biaxially oriented translucent polymer sheet include polyolefins, polyesters, polyamides, polycarbonates, cellulosic esters, polystyrene, polyvinyl resins, polysulfonamides, polyethers, polyimides, polyvinylidene fluoride, polyurethanes, polyphenylenesulfides, polytetrafluoroethylene, polyacetals, polysulfonates, polyester ionomers, and polyolefin ionomers. Copolymers and/or mixtures of these polymers can be used.

Polyolefins, particularly polypropylene, polyethylene, polymethylpentene, and mixtures thereof are preferred for the transparent polymer sheet. Polyolefin copolymers, including copolymers of propylene and ethylene such as hexene, butene and octene are also preferred. Polypropylenes are most preferred polyolefin polymers because they are low in cost and have good strength and surface properties and are transparent after orientation.

Preferred polyesters include those produced from aromatic, aliphatic or cycloaliphatic dicarboxylic acids of 4–20 carbon atoms and aliphatic or alicyclic glycols having from 2–24 carbon atoms. Examples of suitable dicarboxylic acids include terephthalic, isophthalic, phthalic, naphthalene dicarboxylic acid, succinic, glutaric, adipic, azelaic, sebacic, fumaric, maleic, itaconic, 1,4-cyclohexanedicarboxylic, sodiosulfoisophthalic and mixtures thereof. Examples of suitable glycols include ethylene glycol, propylene glycol, butanediol, pentanediol, hexanediol, 1,4-cyclohexanedimethanol, diethylene glycol, other polyethylene glycols and mixtures thereof. Such polyesters are well known in the art and may be produced by well-known techniques, e.g., those described in U.S. Pat. Nos. 2,465,319 and 2,901,466. Preferred continuous matrix polyesters are those having repeat units from terephthalic acid or naphthalene dicarboxylic acid and at least one glycol selected from ethylene glycol, 1,4-butanediol and 1,4-cyclohexanedimethanol. Poly(ethylene terephthalate), which may be modified by small amounts of other monomers, is especially preferred. Other suitable polyesters include liquid crystal copolyesters formed by the inclusion of suitable amount of a co-acid component such as stilbene dicarboxylic acid. Examples of such liquid crystal copolyesters are those disclosed in U.S. Pat. Nos. 4,420,607; 4,459,402, .and 4,468,510.

Polyester is the most preferred polymer for use as a translucent polymer sheet because the polyester polymer is high in strength and is transparent after orientation. Further, polyester polymer has been found to have sufficient modulus to provide a photographic member that is low in curl and highly tear resistant providing an image that can withstand the rigors of consumer handling. Finally, polyester polymer has been shown to reduce the flow of oxygen and nitrogen which have been shown to catalyze the fading of color couplers.

Useful polyamides polymer sheet nylon 6, nylon 66, and mixtures thereof. Copolymers of polyamides are also suitable continuous phase polymers. An example of a useful polycarbonate is bisphenol-A polycarbonate. Cellulosic esters suitable for use as the continuous phase polymer of the composite sheets include cellulose nitrate, cellulose triacetate, cellulose diacetate, cellulose acetate propionate, cellulose acetate butyrate, and mixtures or copolymers thereof.

Useful polyvinyl resins include polyvinyl chloride, poly (vinyl acetal), and mixtures thereof Copolymers of vinyl resins can also be utilized.

The polymers describe above are not naturally translucent. The translucent characteristics are typically achieved by providing voiding in at least one layer of the polymer sheet. Voids may be achieved by any means known in the art.

Suitable base substrates that provide the desired range of transmission and reflective properties are further describe in U.S. Pat. Nos. 6,048,606, 6,074,788 and also 6,030,756. The means for forming such translucent, diffusive and reflective include the lamination of biaxially oriented polymer sheets with the desired optical properties to clear base such as polyester as well as the formation of the desired optical properties in polyester or other polymer that does not require lamination to another base to provide the required mechanical properties. As with most light sensitive silver halide photographic products the incorporation of an antistatic or charge control layer is important for static control as well as transport, and handling of photographic elements.

The translucent sheets have numerous advantages over prior transmission display materials and methods of imaging transmission display materials. The display materials provide very efficient diffusing of light while allowing the transmission of a high percentage of the light. The layers of the coextruded polyester sheet useful in this invention have levels of voiding, optical brightener, and colorants adjusted to provide optimum transmission properties. The polyester sheet has a voided layer to efficiently diffuse the illuminating light source common with transmission display materials without the use of expensive $TiO_2$ or other white pigments. The coextruded polyester base of the invention contains a clear polyester layer to provide stiffness without corrupting the transmission of light. The thickness ratio between the voided layer and the clear layer is at least 1:2. Below a 1:2 ratio, the support would not allow sufficient illumination for a quality image, as the voided layer would be too thick to allow for illumination of the image. The polyester sheet of may have a coextruded integral emulsion adhesion layer. Beyond the transparent layer and the voided layer, a coextruded copolymer layer can be used with corona discharge treatment as a silver halide emulsion adhesion layer, or a primer coating coated with a separate gel sub layer may be coated on the polyester sheets. The voided, oriented polyester sheet is also low in cost, as the functional layer is coextruded at the same time, avoiding the need for further processing such as lamination, priming, or extrusion coating. The material as it contains silver halide imaging layers on both sides of a polymer sheet may be imaged by a collimated beam exposure device in a single exposure. As there are two relatively thin layers of silver halide image materials, the developing of the invention element may be carried out rapidly as the penetration of the developing solution is rapid through the thin layers of imaging material. The materials are low in cost as the coextruded microvoided polymer material sheet is made in one step. Prior art products are typically a two step process or incorporate a bottom pigmented layer during emulsion coating which adds to the drying load and slow the coating process down. The formation of transmission display materials requires a display material that diffuses light so well that individual elements of the illuminating bulbs utilized are not visible to the observer of the displayed image. On the other hand, it is necessary that light be transmitted efficiently to brightly illuminate the display image. These display materials allow a greater amount of illuminating light to actually be utilized as display illumination while at the same time very effectively diffusing the light sources such that they are not apparent to the observer. The display material of the invention will appear whiter to the observer than prior art materials which have a tendency to appear somewhat yellow as they require a high amount of light scattering pigments to prevent the viewing of individual light sources. These high concentrations of pigments appear yellow to the observer and result in an image that is darker than desirable. These and other advantages will be apparent from the detailed description below.

The layers of the coextruded biaxially oriented polyester sheet may have levels of voiding, $TiO_2$ and colorants adjusted to provide optimum transmission properties. The biaxially oriented polyester sheet is coextruded as a multilayer base that has a transparent polymer base and a thin microvoided layer for efficient diffusing for backlite applications, enhanced image processing as well as product handling for display assembling. An important aspect of the translucent imaging support is that it is coated with a light sensitive silver halide emulsion on the top side and the bottom side, this duplitized silver halide coating combined with the optical properties of the biaxially oriented sheet provides an improved photographic display material that can be used in transmission. Another important aspect of this invention is that the dye forming coupler on the back side are in a different light sensitive layer than the dye coupler on the face side. This difference is important to being able to switch colors of the developed image by changing the viewing light source from reflected to transmitted. In addition to being able to switch color and therefore create a sense of motion in an otherwise still image, the duplitized display material has significant commercial value in that prior art photographic display materials required a developer time of 110 seconds compared to a developer time of 45 seconds for the invention. It has been found that the duplitized emulsion top side to bottom side coverage ratio should be in a range of 1:0.6 to 1:1.25. It has been shown that the duplitized emulsion top side to bottom side coverage ratio of 1:1.25 resulted in significant and adverse attenuation of the imaging light which resulted in under exposure of the bottom side emulsion coating. Conversely, a duplitized emulsion top side to bottom side coverage ratio of less than 1:0.6 resulted in significant and adverse attenuation of the imaging light which resulted in over exposure of the top side emulsion coating. A desired duplitized emulsion top side to bottom side coverage ratio is 1:1. A 1:1 ratio allows for efficient exposure and the required dye density for a quality image. In the above case said photographic imaging element a photosensitive silver halide and dye forming coupler in both the top and bottom layers. In order to provide the photographic element for this application one preferred structure comprises a photographic member comprising at least one photosensitive silver halide layer on the top of said member and at least one photosensitive silver halide layer on the bottom of said layer, a polymer sheet comprising at least one layer of voided polyester polymer and at least one layer comprising nonvoided polyester polymer, wherein the imaging element has a percent transmission of between 35 and 65%, the imaging member further comprises tints, and the nonvoided layer is at least twice as thick as the voided layer. This structure is preferred because it provides an optimized integral diffusing screen that is part of the base element structure. The diffusing properties are highly desirable in backlit applications. A primer or subbing coating is necessary when a coating gelatin based emulsion layers on the either side of the translucent sheet because gelatin does not adhere well to polyester. Furthermore a layer of polyethylene may be desirable to enhance adhesion of the backside silver halide emulsion as opposed to a gel sub layer. It should be noted that if two sides of the substrate are coated with light sensitive silver halide emulsions, then both sides may to be cornea treated prior to the first light sensitive layer being applied to the substrate or the emulsion will be fogged. In the case of a duplitized emulsion it may be desirable to further comprise said photographic element with an antihalation layer over the outer most part of the backside emulsion. The antihalation layer is typically a layer of gelatin with "black" or exposed silver. The purpose of such a layer is to provide improved sharpness and to prevent the reexposure of the silver grains once the light has passed through the emulsion.

Any suitable polyester sheet may be utilized for the member provided that it is oriented. The orientation provides added strength to the multi-layer structure that provides enhanced handling properties when displays are assembled. Microvoided oriented sheets may be used because the voids provide opacity without the use of $TiO_2$. Microvoided layers are conveniently manufactured by coextrusion of the core and thin layers, followed by biaxial orientation, whereby voids are formed around void-initiating material contained in the thin layers.

The total thickness of the sheet can range from 76 to 256 micrometers, preferably from 80 to 150 micrometers. Below 80 micrometers, the microvoided sheets may not be thick enough to minimize any inherent handling and kinking problems when handling large sheets of this material. At thickness higher than 15 micrometers, little improvement in either surface smoothness or mechanical properties are seen, and so there is little justification for the further increase in cost for extra materials. In the case of the preferred photographic imaging member, the microvoided layer should have a thickness between 6–50 micrometers. Below 6 micrometers, the diffusing properties of the layer are minimized and above 50 the layer becomes more opaque and hinders the quality for backlighting applications with silver halide emulsion on each side.

"Void" is used herein to mean devoid of added solid and liquid matter, although it is likely the "voids" contain gas. The void-initiating particles which remain in the finished packaging sheet core should be from 0.1 to 10 micrometers in diameter, preferably round in shape, to produce voids of the desired shape and size. The size of the void is also dependent on the degree of orientation in the machine and transverse directions. Ideally, the void would assume a shape, which is defined by two, opposed, and edge contacting concave disks. In other words, the voids tend to have a lens-like or biconvex shape. The voids are oriented so that the two major dimensions are aligned with the machine and transverse directions of the sheet. The Z-direction axis is a minor dimension and is roughly the size of the cross diameter of the voiding particle. The voids generally tend to be closed cells, and thus there is virtually no path open from one side of the voided-core to the other side through which gas or liquid can traverse.

For the biaxially oriented layer on the topside towards the emulsion, suitable classes of thermoplastic polymers for the biaxially oriented sheet and the core matrix-polymer of the preferred composite sheet comprise polyolefins. Suitable polyolefins include polypropylene, polyethylene, polymethylpentene, polystyrene, polybutylene and mixtures thereof. Polyolefin copolymers, including copolymers of propylene and ethylene such as hexene, butene, and octene are also useful. Polyethylene is preferred, as it is low in cost and has good adhesion properties to the photographic emulsion. The polyethylene layer may comprise at least one layer of said polymer base sheet and in particular it may comprises a layer on top of said voided polyester layer Another means to enhance adhesion of a photographic silver halide emulsion on the polyester polymer surface of claim one of this invention is to apply a subbing layer. Typical subbing layers contain materials known in the art to promote adhesion to polyester and furthermore allow gelatin to adhere to the sub layer.

Addenda may be added to the top most skin layer to change the color of the imaging element. For photographic use, a white base with a slight bluish tinge is preferred. The addition of the slight bluish tinge may be accomplished by any process which is known in the art including the machine blending of color concentrate prior to extrusion and the melt extrusion of blue colorants that have been pre-blended at the desired blend ratio. Colored pigments that can resist extrusion temperatures greater than 320° C. are preferred as temperatures greater than 320° C. are necessary for coextrusion of the skin layer. Blue colorants used in this invention may be any colorant that does not have an adverse impact on the imaging element. Preferred blue colorants include Phthalocyanine blue pigments, Cromophtal blue pigments, Irgazin blue pigments, Irgalite organic blue pigments and pigment Blue 60.

It has been found that a very thin coating (0.2 to 1 micrometers) on the surface immediately below the emulsion layer can be made by coextrusion and subsequent stretching in the width and length direction. It has been found that this layer is, by nature, extremely accurate in thickness and can be used to provide all the color corrections which are usually distributed throughout the thickness of the sheet between the emulsion and the paper base. This topmost layer is so efficient that the total colorants needed to provide a correction are less than one-half the amount needed if the colorants are dispersed throughout thickness. Colorants are often the cause of spot defects due to clumps and poor dispersions. Spot defects, which decrease the commercial value of images, are improved with this invention because less colorant is used and high quality filtration to clean up the colored layer is much more feasible since the total volume of polymer with colorant is only typically 2 to 10 percent of the total polymer between the base paper and the photosensitive layer.

Addenda may be added to the biaxially oriented sheet of this invention so that when the biaxially oriented sheet is viewed by the intended audience, the imaging element emits light in the visible spectrum when exposed to ultraviolet radiation. Emission of light in the visible spectrum allows for the support to have a desired background color in the presence of ultraviolet energy. This is particularly useful when images are backlit with a light source that contains ultraviolet energy and may be used to optimize image quality for transmission display applications.

Addenda known in the art to emit visible light in the blue spectrum are preferred. Consumers generally prefer a slight blue tint to white defined as a negative b* compared to a white defined as a b* within one b* unit of zero. b* is the measure of yellow/blue in CIE space. A positive b* indicates yellow while a negative b* indicates blue. The addition of addenda that emits in the blue spectrum allows for tinting the support without the addition of colorants which would decrease the whiteness of the image. The preferred emission is between 1 and 5 delta b* units. Delta b* is defined as the b* difference measured when a sample is illuminated ultraviolet light source and a light source without any significant ultraviolet energy. Delta b* is the preferred measure to determine the net effect of adding an optical brightener to the top biaxially oriented sheet of this invention. Emissions less than 1 b* unit can not be noticed by most customers therefore is it not cost effective to add optical brightener to the biaxially oriented sheet. An emission greater that 5 b* units would interfere with the color balance of the prints making the whites appear too blue for most consumers.

A preferred addenda is an optical brightener. An optical brightener is substantially colorless, fluorescent, organic compound that absorbs ultraviolet light and emits it as visible blue light. Examples include but are not limited to derivatives of 4,4'-diaminostilbene-2,2'-disulfonic acid, coumarin derivatives such as 4-methyl-7-diethylaminocoumarin, 1-4-Bis (0-Cyanostyryl) Benzol and 2-Amino- 4-Methyl Phenol. An unexpected desirable feature of this is efficient use of optical brightener. Because the ultraviolet source for a transmission display material is on the opposite side of the image, the ultraviolet light intensity is not reduced by ultraviolet filters common to imaging layers. The result is less optical brightener is required to achieve the desired background color.

The translucent sheet may comprises a polymer sheet with at least one voided polyester skin layer and at least one nonvoided polyester polymer layer should comprise a void space between about 2 and 60% by volume of said voided layer of said polymer sheet. Such a void concentration is desirable to optimize the transmission and reflective properties while providing adequate diffusing power to hide back lights and filaments.

The biaxially oriented coextruded polymer sheet may also contain white pigments, which are known to improve the photographic responses such as whiteness or sharpness. Titanium dioxide is used to improve image sharpness because of the unique particle size and geometry. Further, both anatase and rutile $TiO_2$ may be blended to improve both whiteness and sharpness. Examples of $TiO_2$ that are acceptable for a photographic system are Dupont Chemical Co. R101 rutile $TiO_2$ and DuPont Chemical Co. R104 rutile $TiO_2$. Other pigments to improve photographic responses may also be used in this invention such as titanium dioxide, barium sulfate, clay, or calcium carbonate.

The preferred amount of $TiO_2$ added to the biaxially oriented sheet of this invention is between 4 and 18% by weight. Below 3% $TiO_2$, the required light transmission can not be easily achieved with microvoiding alone. Combining greater than 4% $TiO_2$ with voiding provides a biaxially oriented, micro voided sheet that is low in cost. Above 14% $TiO_2$, additional dye density is required to overcome the loss in transmission.

The preferred spectral transmission for a day/night biaxially oriented coextruded polyester sheet of this invention is at between 35 to 65%. This range is preferred because it provides for optimal viewing with either backlighting or front viewing in daylight or room light conditions. Spectral transmission is the amount of light energy that is transmitted through a material. For a photographic element, spectral transmission is the ratio of the transmitted power to the incident power and is expressed as a percentage as follows; T.sub.RGB=10 sup.–D * 100 where D is the average of the red, green and blue Status A transmission density response measured by an X-Rite model 310 (or comparable) photographic transmission densitometer. The higher the transmission, the less opaque the material. For a transmission display material with an incorporated diffuser, the quality of the image is related to the amount of light reflected from the image to the observer's eye. A transmission display image with a low amount of spectral transmission does not allow sufficient illumination of the image causing a perceptual loss in image quality. A transmission image with a spectral transmission of less than 35% is unacceptable for a transmission display material as the quality of the image can not match prior art transmission display materials. Further, spectral transmissions less than 35% will require additional dye density that increases the cost of the transmission display material. Any spectral transmission greater than 35% provides acceptable image quality. However as the spectral transmission approaches 65%, it has been found that the materials do not sufficiently diffuse the backlighting illuminate.

These coextruded sheets may be coated or treated after the coextrusion and orienting process or between casting and full orientation with any number of coatings which may be used to improve the properties of the sheets including printability, to provide a vapor barrier, or to improve the adhesion to the support or to the photosensitive layers. Examples of this would be acrylic coatings for printability, coating polyvinylidene chloride for heat seal properties or barrier properties. Further examples include flame, plasma or corona discharge treatment to improve printability or adhesion. In addition it is also possible to provide either an integral layer or a separately coated layer of either an electrical conductive or charge control layer to minimize the generation of electrostatic glow or discharge of a photosensitive imaging member. The preferred embodiment is a photographic member comprising at least one photosensitive silver halide layer on the top of said member and at least one photosensitive silver halide layer on the bottom of said layer, a polymer sheet comprising at least one layer of voided polyester polymer and at least one layer comprising nonvoided polyester polymer, wherein the imaging member has a percent transmission of between 35 and 65%, the imaging member further comprises tints, and the nonvoided layer is at least twice as thick as the voided layer and the member further comprises at least one layer comprising a charge control and or having a electrical resistivity of less than $10^{11}$ ohms per square below the said polyethylene layer of the top most part of the base member. In the case of a charge control layer that is either integral to another functional layer or a functional layer by itself, the charge control agents should be substantially electrical neutral to the photosensitive emulsion or its protective overcoat.

The polyester utilized in the translucent sheets should have a glass transition temperature between about 50° C. and about 150° C., preferably about 60–100° C., should be orientable, and have an intrinsic viscosity of at least 0.50, preferably 0.6 to 0.9. Suitable polyesters include those produced from aromatic, aliphatic, or cyclo-aliphatic dicarboxylic acids of 4–20 carbon atoms and aliphatic or alicyclic glycols having from 2–24 carbon atoms. Examples of suitable dicarboxylic acids include terephthalic, isophthalic, phthalic, naphthalene dicarboxylic acid, succinic, glutaric, adipic, azelaic, sebacic, fumaric, maleic, itaconic, 1,4-cyclohexane-dicarboxylic, sodiosulfoiso-phthalic, and mixtures thereof. Examples of suitable glycols include ethylene glycol, propylene glycol, butanediol, pentanediol, hexanediol, 1,4-cyclohexane-dimethanol, diethylene glycol, other polyethylene glycols and mixtures thereof. Such polyesters are well known in the art and may be produced by well-known techniques, e.g., those described in U.S. Pat. Nos. 2,465,319 and 2,901,466. Preferred continuous matrix polymers are those having repeat units from terephthalic acid or naphthalene dicarboxylic acid and at least one glycol selected from ethylene glycol, 1,4-butanediol, and 1,4-cyclohexanedimethanol. Poly (ethylene terephthalate), which may be modified by small amounts of other monomers, is especially preferred. Polypropylene is also useful. Other suitable polyesters include liquid crystal copolyesters formed by the inclusion of a suitable amount of a co-acid component such as stilbene dicarboxylic acid. Examples of such liquid crystal copolyesters are those disclosed in U.S. Pat. Nos. 4,420,607; 4,459,402 and 4,468,510.

Additional details as well as a description of suitable cross-linked polymer microbeads that may be used to help form the voids in the polyester core are provided in U.S. Pat. No. 6,074,788. When the microbeads have become uniformly dispersed in the matrix polymer, a film support is formed by processes such as extrusion or casting. Examples of extrusion or casting would be extruding or casting a film or sheet. Such forming methods are well known in the art. If sheets or film material are cast or extruded, it is important that such article be oriented by stretching, at least in one direction. Methods of unilaterally or bilaterally orienting sheet or film material are well known in the art. Basically, such methods comprise stretching the sheet or film at least in the machine or longitudinal direction after it is cast or extruded an amount of about 1.5–10 times its original dimension. Such sheet or film may also be stretched in the transverse or cross-machine direction by apparatus and methods well known in the art, in amounts of generally 1.5–10 (usually 3–4 for polyesters and 6–10 for polypropylene) times the original dimension. Such apparatus and methods are well known in the art and are described in such U.S. Pat. No. 3,903,234.

The voids, or void spaces, referred to herein surrounding the microbeads are formed as the continuous matrix polymer is stretched at a temperature above the Tg of the matrix polymer. The microbeads of cross-linked polymer are relatively hard compared to the continuous matrix polymer. Also, due to the incompatibility and immiscibility between the microbead and the matrix polymer, the continuous matrix polymer slides over the microbeads as it is stretched, causing voids to be formed at the sides in the direction or directions of stretch, which voids elongate as the matrix polymer continues to be stretched. Thus, the final size and shape of the voids depends on the direction(s) and amount of stretching. If stretching is only in one direction, microvoids will form at the sides of the microbeads in the direction of stretching. If stretching is in two directions (bidirectional stretching), in effect such stretching has vector components extending radially from any given position to result in a doughnut-shaped void surrounding each microbead.

The preferred perform stretching operation simultaneously opens the microvoids and orients the matrix material. The final product properties depend on and can be controlled by stretching time-temperature relationships and on the type and degree of stretch. For maximum opacity and texture, the stretching is done just above the glass transition temperature of the matrix polymer. When stretching is done in the neighborhood of the higher glass transition temperature, both phases may stretch together and opacity decreases. In the former case, the materials are pulled apart, a mechanical anticompatibilization process. Two examples are high-speed melt spinning of fibers and melt blowing of fibers and films to form nonwoven/spun-bonded products. In summary, the scope of this invention includes the complete range of forming operations just described.

In general, void formation occurs independent of, and does not require, crystalline orientation of the matrix polymer. Opaque, microvoided films have been made in accordance with the methods of this invention using completely amorphous, noncrystallizing copolyesters as the matrix phase. Crystallizable/orientable (strain hardening) matrix materials are preferred for some properties like tensile strength and gas transmission barrier. On the other hand, amorphous matrix materials have special utility in other areas like tear resistance and heat sealability. The specific matrix composition can be tailored to meet many product needs. The complete range from crystalline to amorphous matrix polymer is part of the invention.

In the formation of photographic elements it is important that they be design to efficiently transport through processing equipment to minimize jamming and other problems. In such a case the back of said imaging member should have a roughness of between 0.3 and 2.0 micrometers. This range of roughness helps to modify the frictional characteristics to optimize the photographic finishing and transport of this material. Furthermore it is also desirable to control the roughness characteristic of the top most side. In this case it is desirable to incorporate roughness to help prevent finger printing and damage to the image side of the element. An improved roughness position also helps in assembling the display, as a slightly non-smooth surface will slide more easily into a display frame with protective over cover. In addition the roughened surface provides additional advantage in reducing gloss for those application that a softer mood or message is being created with the image material. The photographic imaging element of this invention may also be designed wherein the top of said imaging member has a surface roughness of between 0.02 and 0.2 micrometers.

The structure of a preferred biaxially oriented coextruded sheet where the silver halide imaging layers are coated on the polyethylene skin and the gelatin coated layer is as follows:

Polyethylene with blue pigment
Copolymer ethylene acrylate
Microvoided polyester layer with optical brightener and $TiO_2$
Solid polyester core
Coated gelatin layer In addition to providing a translucent polymer sheet made from polyester with above described optical transmission properties, it is also possible to provide a sheet of biaxially oriented sheet of polypropylene that has been laminated to a sheet of clear polyester. The description of this translucent polymer sheet is given in U.S. Pat. No. 6,030,756. The translucent polymer sheet preferably is provided with an integral emulsion adhesion layer to avoid the need for expensive primer and sub coatings known in the art to improve gelatin adhesion to polymer sheets. An example of a suitable integral emulsion adhesion layer is described in U.S. Pat. No. 5,866,282 (Bourdelais et al). The most preferred integral emulsion adhesion layer is a layer of polyethylene that is corona discharge treated (CDT) treated prior to the coating of light sensitive silver halide imaging layers. In addition the translucent polymer sheet may further comprise and antitstatic layer on at least one side of the sheet and preferably under the light sensitive layer on at least one side. The layer may have a surface resistivity of at least $10^{13}$ log ohms/sq.

The developed silver halide image layers preferably contain an environmental protection layer or EPL to protect the delicate silver halide formed image from handling damage and damage caused from exposure to liquids. Examples of liquids that can damage the silver halide formed image include water, coffee, soda, and the like. Preferred EPLs include UV curable polymers, latex, acrylic, and laminated polymer sheets.

Since the transparent polymer sheet is coated with silver halide imaging layers that are oxygen and moisture sensitive, the transparent sheet of the invention preferably contains oxygen and moisture barrier properties to improve, for example, gelatin hardening which depends the moisture gradient between the machine dryer and the gelatin imaging layers. The preferred water transmission rate of the transparent polymer sheet is between 5 and 500 grams/$m^2$/day utilizing test method ASTM F1249. Below 1 gram/$m^2$/day, expensive auxiliary coatings are required to reduce water transmission. Above 600 grams/$m^2$/day, little improvement in gelatin hardening has been observed. The preferred oxygen transmission rate of the transparent polymer sheet is between 2 and 120 cc/$m^2$/day utilizing test method D3985. Below 1 cc/$m^2$/day, expensive coatings are required to reduce the oxygen transmission rate. Above 150 cc/$m^2$/day, little improvement in dye fade, which is known in the art to be accelerated in the presence of oxygen, has been observed.

Another unique feature of a preferred form of this invention is the addition of an antihalation layer to the bottommost layer of the backside imaging element. The antihalation layer prevents unwanted secondary exposure of the silver crystals in the imaging layer as light is absorbed in the antihalation layer during exposure. The prevention of secondary exposure of the light sensitive silver crystals, will significantly increase the sharpness of the image and preserve the inherent dye hue of the couplers utilized in the invention without the use of $TiO_2$ which is commonly used in prior art photographic display materials.

It has also been found that polymer chemistry can be added to the biaxially oriented polymer sheet to provide ultraviolet protection to the backside color couplers used in the developed image layer. Traditionally, this protection for prior art materials has been provided in the gelatin overcoat layer. The incorporation of the ultraviolet protection materials in the biaxially oriented polymer sheet of this invention provides better ultraviolet protection to the imaging couplers and is lower in cost as less ultraviolet filter materials are required in the biaxially oriented sheet than in a gelatin overcoat. By providing additional ultraviolet protection to the backside image dyes, the overall dye fading performance of the entire imaging element is enhanced because in transmission, the image observed is a combination of the front side image and the backside image. If the backside image fades less than the overall perception is less fading.

A transmissive polymer sheet that has an L* greater than 92.0 is preferred as transmissive polymer sheet with L* less than 85.0 are not bright enough for a high quality display image. A white transmissive polymer sheet is preferred as the white content or density minimum areas in an image are created by the whiteness of the base because silver halide imaging systems can not as of yet create the color "white".

A polymer transmissive polymer sheet is typically smooth resulting in a high quality glossy image. Further, addenda may be added to the polymer transmissive polymer sheet to improve the sharpness and whiteness of the image. Addenda such as white pigments to improve the density minimum areas of the image, optical brightener to prove a blue tint to the density minimum areas and blue tint to off set the native yellowness of the gelatin utilized in the silver halide imaging members. Examples of suitable polymers for a transmissive polymer sheet are those disclosed in U.S. Pat. Nos. 4,912,333; 4,994,312; 5,055,371; and 4,187,133. Voided polyester white reflective sheets are preferred as white pigment content in polyester can approach 70% by weight of polymer producing a exceptionally white density minimum area. Voided polyolefin sheets are preferred, as they tend to be low in cost and high in mechanical modulus that results in a stiff photograph.

The polyester film will typically contain an undercoat or primer layer on both sides of the polyester film. Subbing layers used to promote adhesion of coating compositions to the support are well known in the art and any such material can be employed. Some useful compositions for this purpose include interpolymers of vinylidene chloride such as vinylidene chloride/methyl acrylate/itaconic acid terpolymers or vinylidene chloride/acrylonitrile/acrylic acid terpolymers, and the like. These and other suitable compositions are described, for example, in U.S. Pat. Nos. 2,627,088; 2,698,240; 2,943,937, 3,143,421; 3,201,249; 3,271,178; 3,443,950; 3,501,301. The polymeric subbing layer is usually overcoated with a second subbing layer comprised of gelatin, typically referred to as gel sub. The base also may be a microvoided polyethylene terephalate such as disclosed in U.S. Pat. Nos. 4,912,333; 4,994,312; 5,055,371 and 6,048,606.

Another preferred transmissive polymer sheet comprises a composite structure that includes a polyolefin voided polymer sheet adhesively adhered to a transparent polyester sheet. A composite structure consisting of a transmissive polyolefin sheet and transparent polyester sheet allows for a low cost, high quality transmissive polymer sheet as this combination allows for the use of low cost of polyolefin to be used in combination with the desirable performance characteristics of a polyester sheet. Examples transmissive polyolefin sheets in combination with polyester sheets are those disclosed in U.S. Pat. Nos. 6,017,685, 6,030,756; and 6,063,552.

To adhere the transparent sheet with the developed image layers to the transmissive polymer sheet a bonding layer is required. The bonding layer must provide excellent adhesion between the imaging layers and the transmissive polymer sheet for the useful life of the image. The preferred method of adhering the imaging layers and transmissive polymer sheet is by use of an adhesive. The adhesive preferably is coated or applied to the transmissive polymer sheet. The adhesive preferably is a pressure sensitive adhesive or heat activated adhesive. During the bonding process, the imaging layers are adhered to the transmissive polymer sheet by use of a nip roller or a heated nip roll in the case of a heat activated adhesive. A preferred pressure sensitive adhesive is an acrylic based adhesive. Acrylic adhesives have been shown to provide an excellent bond between gelatin developed imaging layers and biaxially oriented polymer base sheets.

The preferred thickness of the adhesive layer is between 2 and 40 micrometers. Below 1 micrometer, uniformity of the adhesive is difficult to maintain leading to undesirable coating skips. Above 45 micrometers, little improvement in adhesion and coating quality is observed and therefore increased adhesive is not cost justified. An important property of the adhesion layer between the developed silver halide imaging layers and the white reflective sheet is the optical transmission of the adhesive layer. A laminated adhesive layer with an optical transmission greater than 90% is preferred as the adhesive should not interfere with the quality of the image.

The preferred method of creating a switchable photographic image comprises an imaging element comprising a translucent sheet, and at least three photosensitive dye forming coupler containing layers on the face side of said sheet, wherein said at least three photosensitive forming coupler containing layers comprise a cyan dye forming layer comprising a cyan dye forming coupler in combination with a red sensitized photosensitive emulsion, a yellow dye forming layer comprising a yellow dye forming coupler in combination with a blue light sensitive photosensitive emulsion, a magenta dye forming layer comprising a magenta dye forming coupler and a green light sensitive photosensitive emulsion, and on the back side of said translucent polymer sheet at least one dye forming coupler comprising magenta dye forming coupler, cyan dye forming coupler, or yellow dye forming coupler in combination with a light sensitive silver halide emulsion sensitive to a different wavelength of visible light than it was in combination with on the face side imaging said member, developing said image, placing the developed image at spaced separation from a light source, controlling said light source such that its intensity varies. This method is preferred because it is an imaging element that is high in image quality and it may be viewed in either reflective or transmitted light and furthermore the color of imaging element may be changed simply by varying the intensity of the back light.

The preferred image display device used in this invention comprises a switchable photographic image comprising an imaging element comprising a translucent sheet, and at least three dye containing layers on the face side of said sheet, wherein said at least three dye containing layers comprise a cyan dye containing layer, a magenta dye containing layer and a yellow dye containing layer, and on the back side of said translucent polymer sheet at least one dye containing layer comprising a magenta dye, yellow dye or cyan dye and a variable intensity light source positioned behind said switchable photographic image. By rapidly modulating said variable intensity light source the image can change color quickly and is very effective in grabbing the viewer's attention. In an additional embodiment, said variable intensity light as it transmits through the imaging element comprises a color other than white. This method is preferred because by changing the color of the back light, D-min or white areas in the image may be switched in color. In large commercial display where there are large areas of white, being able to change the color appearance is a very effective way to get the viewers attention.

The imaging elements of this invention are photographic elements, in which the image-forming layer is a radiation-sensitive silver halide emulsion layer. Such emulsion layers typically comprise a film-forming hydrophilic colloid. The most commonly used of these is gelatin and gelatin is a particularly preferred material for use in this invention. Useful gelatins include alkali-treated gelatin (cattle bone or hide gelatin), acid-treated gelatin (pigskin gelatin) and gelatin derivatives such as acetylated gelatin, phthalated gelatin and the like. Other hydrophilic colloids that can be utilized alone or in combination with gelatin include dextran, gum arabic, zein, casein, pectin, collagen derivatives, collodion, agar-agar, arrowroot, albumin, and the like. Still other useful hydrophilic colloids are water-soluble polyvinyl compounds such as polyvinyl alcohol, polyacrylamide, poly (vinylpyrrolidone), and the like.

Color photographic elements of this invention typically contain dye image-forming units sensitive to each of the three primary regions of the spectrum. Each unit can be comprised of a single silver halide emulsion layer or of multiple emulsion layers sensitive to a given region of the spectrum. The layers of the element, including the layers of the image-forming units, can be arranged in various orders as is well known in the art.

The photographic element on top side of the imaging element may comprises a support bearing at least one blue-sensitive silver halide emulsion layer having associated therewith a yellow image dye-providing material, at least one green-sensitive silver halide emulsion layer having associated there with a magenta image dye-providing material and at least one red-sensitive silver halide emulsion layer having associated there with a cyan image dye-providing material while the photographic light sensitive emulsion on the bottom side has the image dye providing material in a different color sensitive silver halide layer than that on the top side. In addition to emulsion layers, the photographic layer can contain auxiliary layers conventional in photographic elements, such as overcoat layers, spacer layers, filter layers, interlayers, antihalation layers, pH lowering layers (sometimes referred to as acid layers and neutralizing layers), timing layers, opaque reflecting layers, opaque light-absorbing layers and the like. The support can be any suitable support as describe in this invention. Typical supports include polymeric films, polymeric film laminated to other polymeric films, glass and the like. The important thing is to have translucent support that is both reflective and diffusive. The light-sensitive silver halide emulsions employed in the photographic elements of this invention can include coarse, regular or fine grain silver halide crystals or mixtures thereof and can be comprised of such silver halides as silver chloride, silver bromide, silver bromoiodide, silver chlorobromide, silver chloroiodide, silver chorobromoiodide, and mixtures thereof. The emulsions can be, for example, tabular grain light-sensitive silver halide emulsions. The emulsions can be negative-working or direct positive emulsions. They can form latent images predominantly on the surface of the silver halide grains or in the interior of the silver halide grains. They can be chemically and spectrally sensitized in accordance with usual practices. The emulsions typically will be gelatin emulsions although other hydrophilic colloids can be used in accordance with usual practice. Details regarding the silver halide emulsions are contained in Research Disclosure, Item 36544, September, 1994, and the references listed therein as well as *Research Disclosure*, September 1994, Item 36544, Section I, published by Kenneth Mason Publications, Ltd., Dudley Annex, 12a North Street, Emsworth, Hampshire PO10 7DQ, ENGLAND.

The photographic silver halide emulsions utilized in this invention can contain other addenda conventional in the photographic art. Useful addenda are described, for example, in Research Disclosure, Item 36544, September, 1994 and *Research Disclosure*, September 1994, Item 36544, Section I, published by Kenneth Mason Publications, Ltd., Dudley Annex, 12a North Street, Emsworth, Hampshire PO10 7DQ, ENGLAND. Useful addenda include spectral sensitizing dyes, desensitizers, antifoggants, masking couplers, DIR couplers, DIR compounds, antistain agents, image dye stabilizers, absorbing materials such as filter dyes and UV absorbers, light-scattering materials, coating aids, plasticizers and lubricants, and the like.

Depending upon the dye-image-providing material employed in the photographic element; it can be incorporated in the silver halide emulsion layer or in a separate layer associated with the emulsion layer. The dye-image-providing material can be any of a number known in the art, such as dye-forming couplers, bleachable dyes, dye developers and redox dye-releasers, and the particular one employed will depend on the nature of the element, and the type of image desired. Dye-image-providing materials employed with conventional color materials designed for processing with separate solutions are preferably dye-forming couplers; i.e., compounds which couple with oxidized developing agent to form a dye. Preferred couplers that form cyan dye images are phenols and naphthols.

Image dye-forming couplers may be included in the element such as couplers that form cyan dyes upon reaction with oxidized color developing agents which are described in such representative patents and publications as: U.S. Pat. Nos. 2,367,531; 2,423,730; 2,474,293; 2,772,162; 2,895,826; 3,002,836; 3,034,892; 3,041,236; 4,883,746 and "Farbkuppler—Eine Literature Ubersicht," published in Agfa Mitteilungen, Band III, pp. 156–175 (1961). Preferably such couplers are phenols and naphthols that form cyan dyes on reaction with oxidized color developing agent. Also preferable are the cyan couplers described in, for instance, European Patent Application Nos. 491,197; 544,322; 556,700; 556,777; 565,096; 570,006; and 574,948.

Typical cyan couplers are represented by the following formulas:

CYAN-1

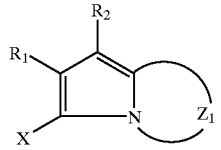

CYAN-2

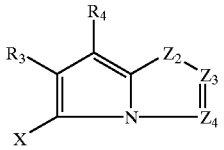

-continued

CYAN-3

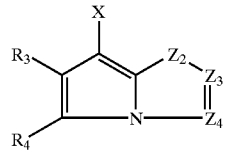

CYAN-4

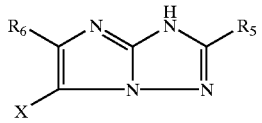

wherein $R_1$, $R_5$ and $R_8$ each represents a hydrogen or a substituent; $R_2$ represents a substituent; $R_3$, $R_4$ and $R_7$ each represents an electron attractive group having a Hammett's substituent constant σpara of 0.2 or more and the sum of the $\sigma_{para}$ values of $R_3$ and $R_4$ is 0.65 or more, $R_6$ represents an electron attractive group having a Hammett's substituent constant $\sigma_{para}$ of 0.35 or more; X represents a hydrogen or a coupling-off group; $Z_1$ represents nonmetallic atoms necessary for forming a nitrogen-containing, six-membered, heterocyclic ring which has at least one dissociative group; $Z_2$ represents —C($R_7$)═and —N═; and Z3 and $Z_4$ each represents —($R_8$)═and —N═.

Preferred couplers which form magenta dye images are pyrazolones and pyrazolotriazoles. Preferred couplers which form yellow dye images are benzoylacetanilides and pivalylacetanilides.

The following examples further illustrate preferred coupler of the invention. It is not to be construed that the present invention is limited to these examples.

IC-1

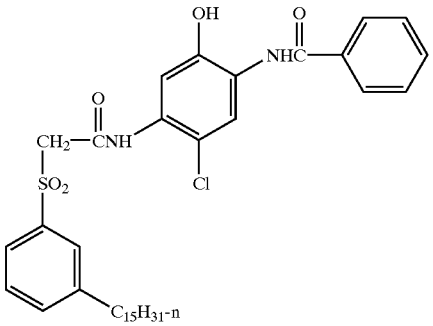

IC-2

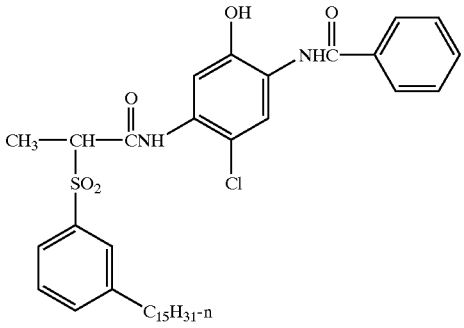

-continued

IC-3

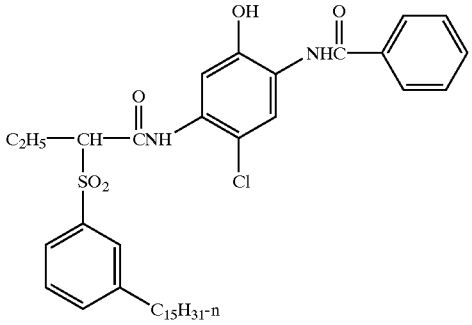

IC-4

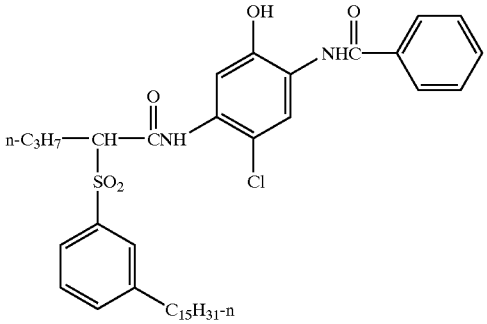

IC-5

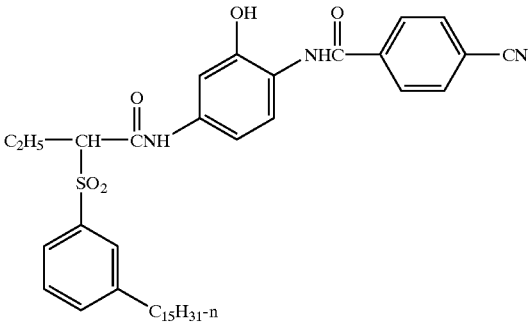

IC-6

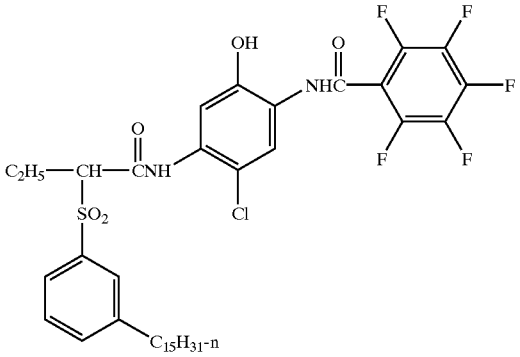

-continued
IC-7
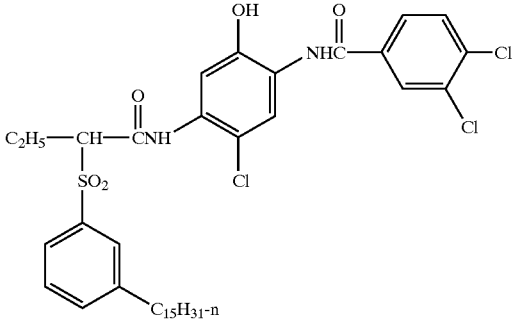
IC-8
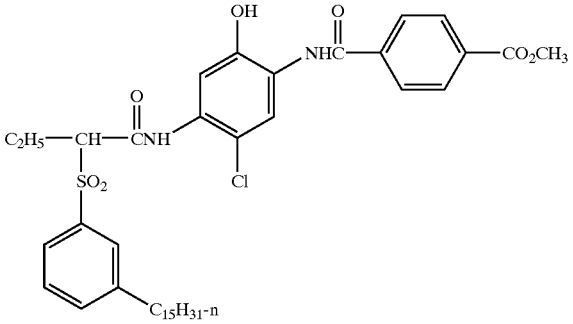
IC-9
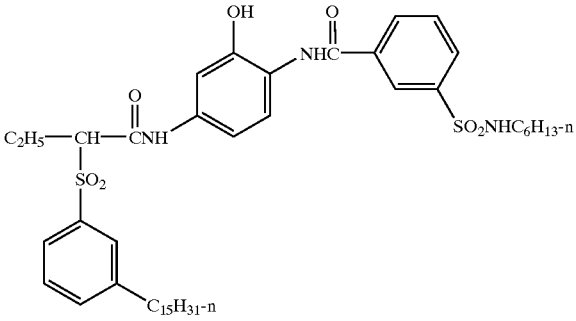
IC-10
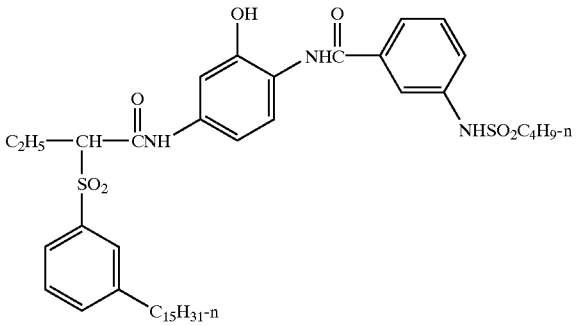
-continued
IC-11
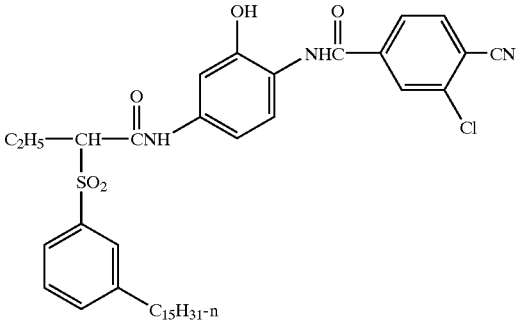
IC-12
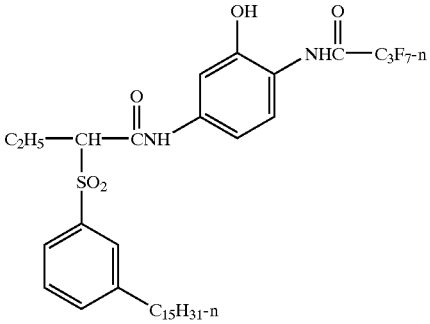
IC-13
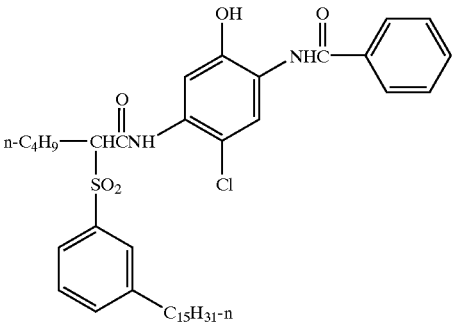
IC-14
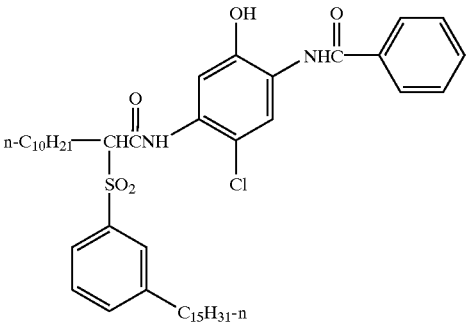

-continued
IC-15
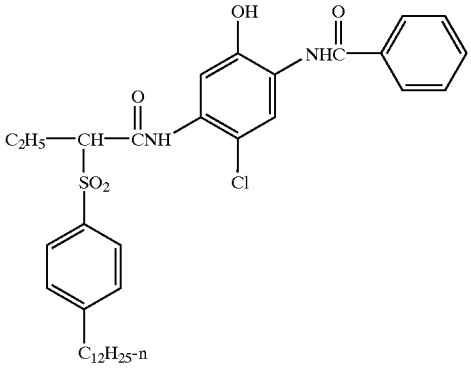
IC-16
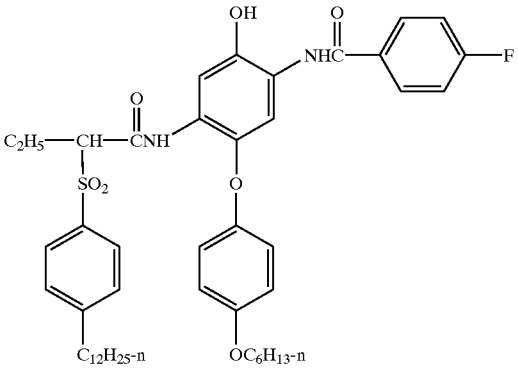
IC-17
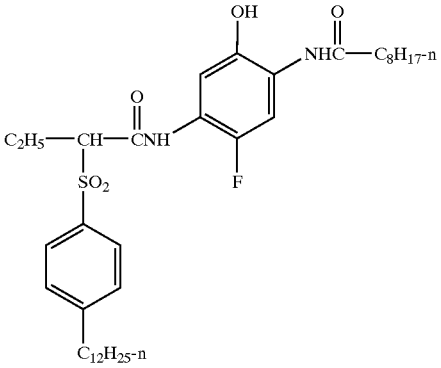
IC-18
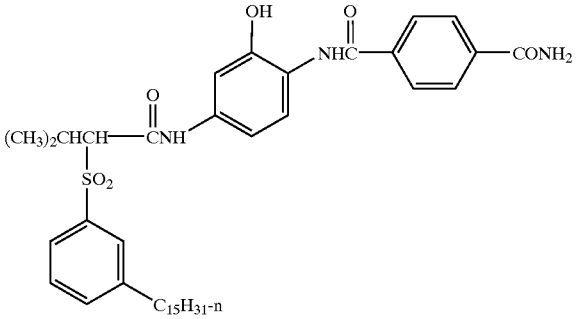
-continued
IC-19
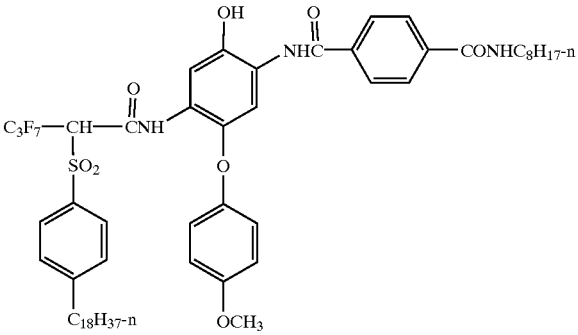
IC-20
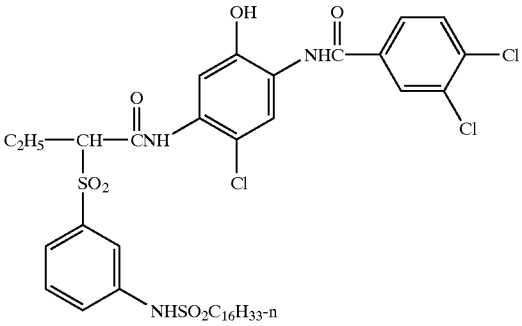
IC-21
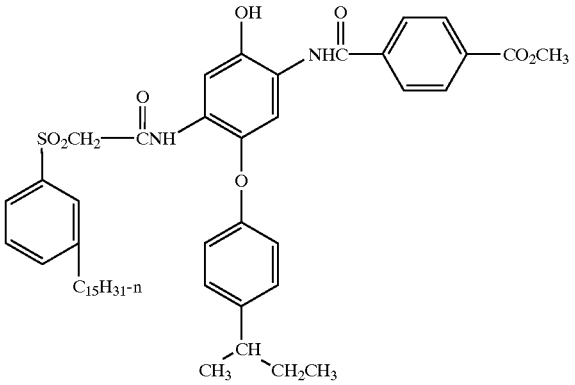
IC-22
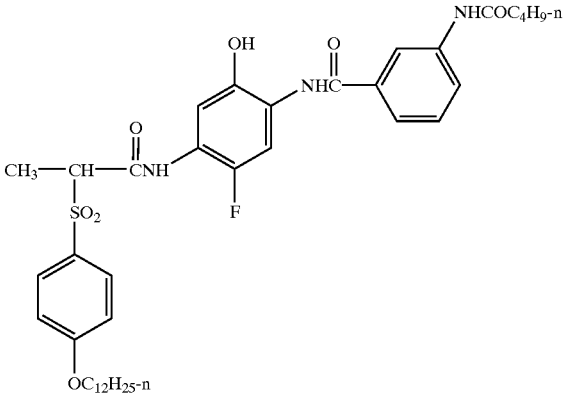

-continued
IC-23
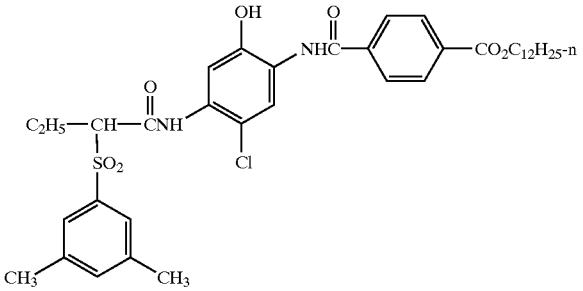
IC-24
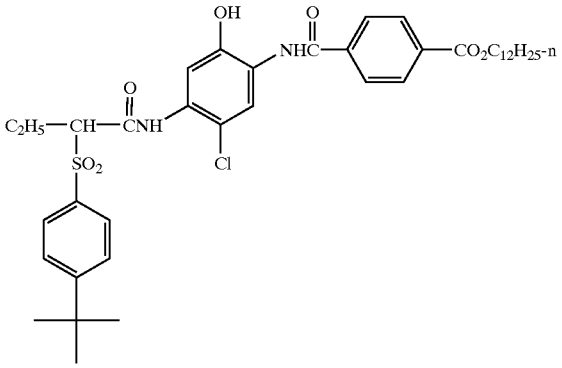
IC-25
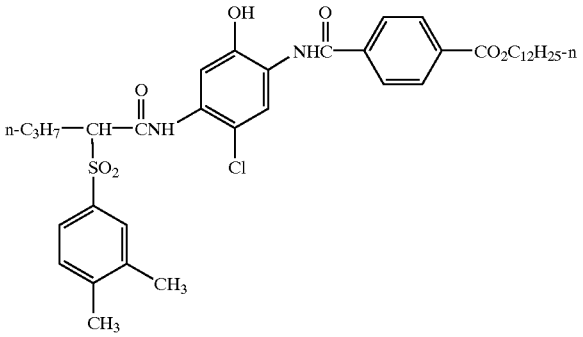
IC-26
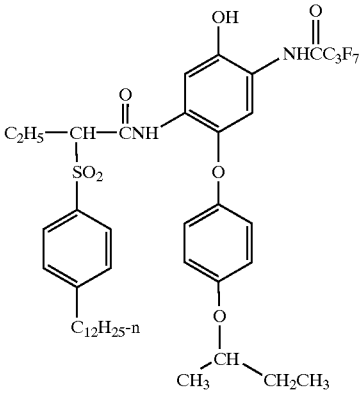
-continued
IC-27
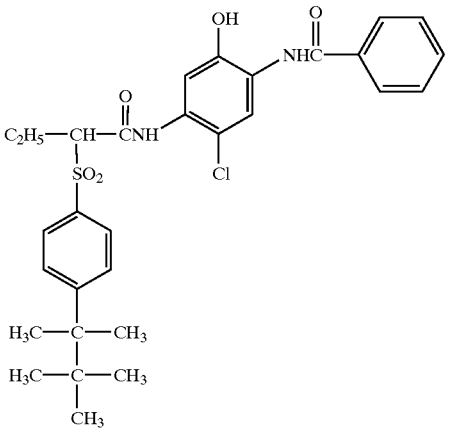
IC-28
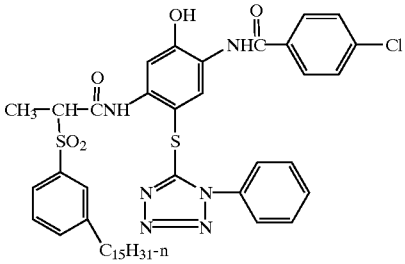
IC-29
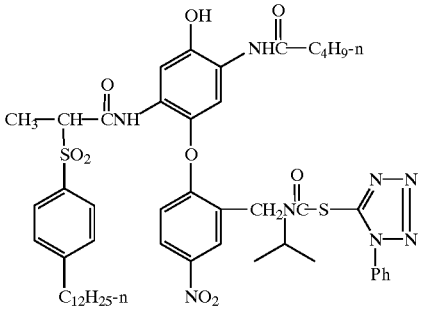
IC-30
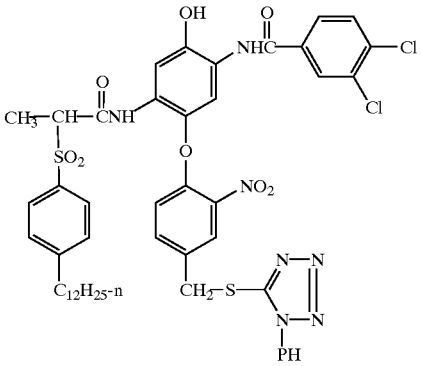

-continued
IC-31
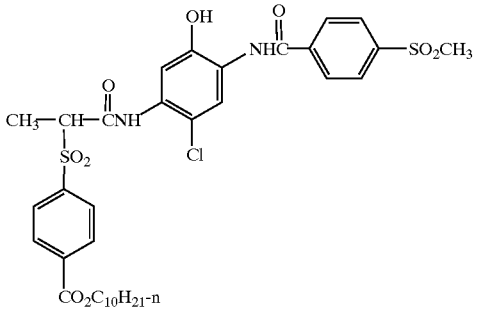
IC-32
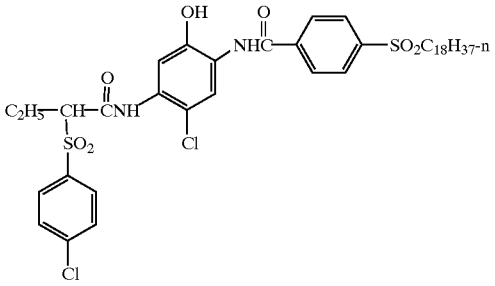
IC-33
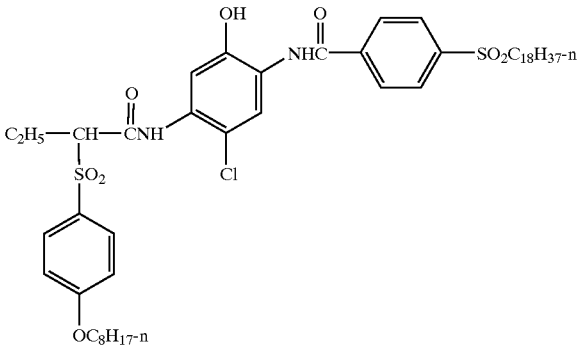
IC-34
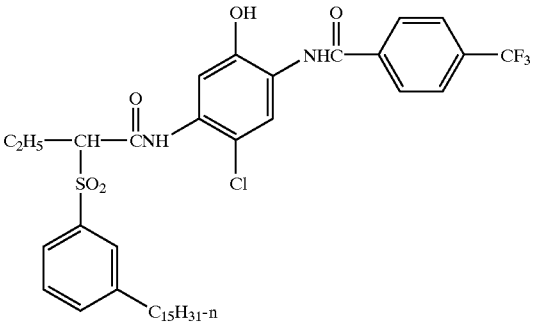
-continued
IC-35
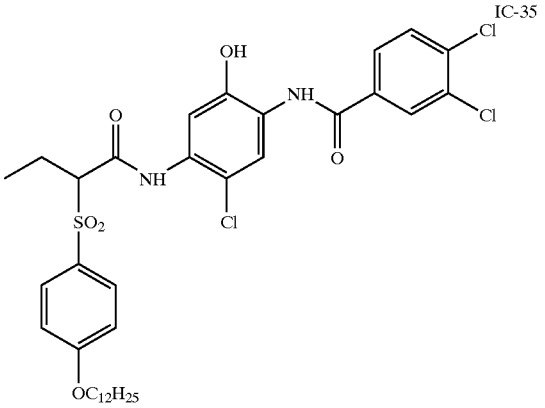
IC-36
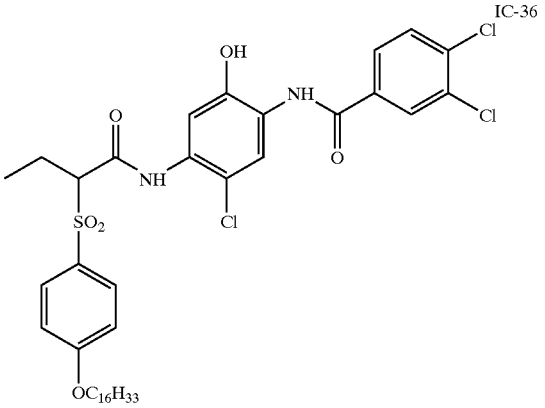
IC-37
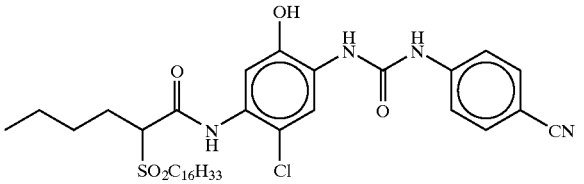
IC-38
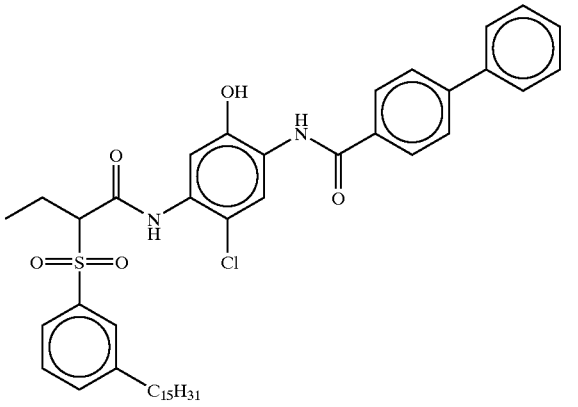

-continued

IC-39

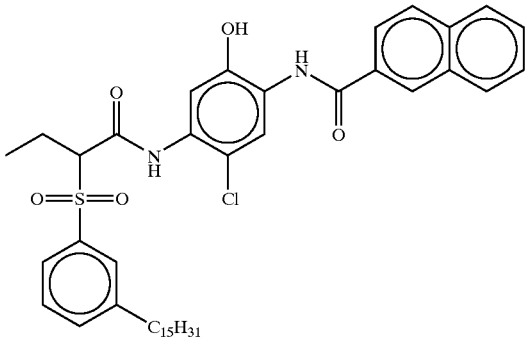

IC-40

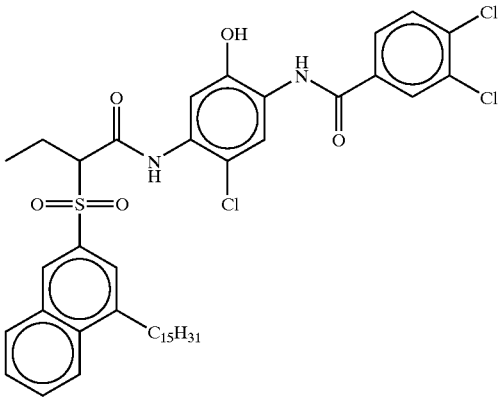

Preferred couplers are IC-3, IC-7, IC-35, and IC-36 because of their suitably narrow left bandwidths.

Couplers that form magenta dyes upon reaction with oxidized color developing agent are described in such representative patents and publications as: U.S. Pat. Nos. 2,311,002; 2,343,703; 2,369,489; 2,600,788; 2,908,573, 3,062,653; 3,152,896; 3,519,429; 3,758,309; and "Farbkupplereine Literature Ubersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents. Especially preferred couplers are 1H-pyrazolo [5,1-c]-1,2,4-triazole and 1H-pyrazolo [1,5-b]-1,2,4-triazole. Examples of 1H-pyrazolo [5,1-c]-1,2,4-triazole couplers are described in U.K. Pat. Nos. 1,247,493; 1,252,418; 1,398,979; U.S. Pat. Nos. 4,443,536; 4,514,490; 4,540,654; 4,590,153; 4,665,015; 4,822,730; 4,945,034; 5,017,465; and 5,023,170. Examples of 1H-pyrazolo [1,5-b]-1,2,4-triazoles can be found in European Patent applications 176,804; 177,765; U.S Pat. Nos. 4,659,652; 5,066,575; and 5,250,400.

Typical pyrazoloazole and pyrazolone couplers are represented by the following formulas:

MAGENTA-1

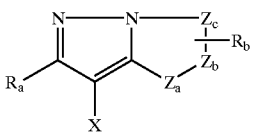

-continued

MAGENTA-2

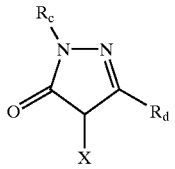

wherein $R_a$ and $R_b$ independently represents H or a substituent, $R_c$ is a substituent (preferably an aryl group), $R_d$ is a substituent (preferably an anilino, carbonamido, ureido, carbamoyl, alkoxy, aryloxycarbonyl, alkoxycarbonyl, or N-heterocyclic group); X is hydrogen or a coupling-off group; and $Z_a$, $Z_b$, and $Z_c$ is independently a substituted methine group, =N—, =C—, or —NH—, provided that one of either the $Z_a$—$Z_b$ bond or the $Z_b$—$Z_c$ bond is a double bond and the other is a single bond, and when the $Z_b$—$Z_c$ bond is a carbon-carbon double bond, it may form part of an aromatic ring, and at least one of $Z_a$, $Z_b$, and $Z_c$ represents a methine group connected to the group $R_b$.

Specific examples of such couplers are:

M-1

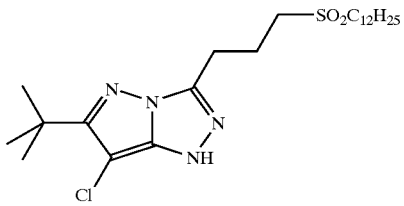

M-2

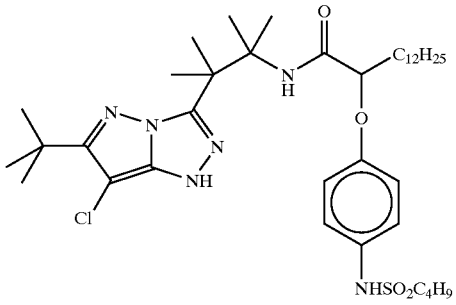

M-3

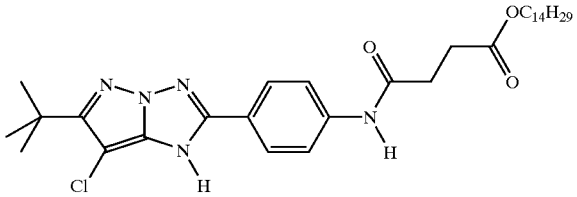

M-4

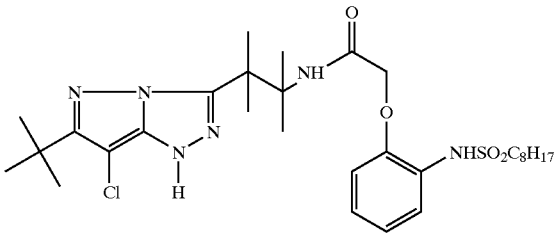

-continued

M-5

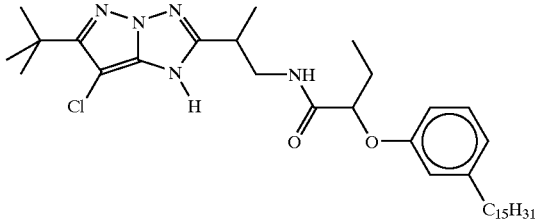

Couplers that form yellow dyes upon reaction with oxidized color developing agent are described in such representative patents and publications as: U.S. Pat. Nos. 2,298,443; 2,407,210; 2,875,057; 3,048,194; 3,265,506; 3,447,928; 3,960,570; 4,022,620; 4,443,536; 4,910,126; and 5,340,703 and "Farbkuppler-eine Literature Ubersicht," published in Agfa Mitteilungen, Band III, pp. 112-126 (1961). Such couplers are typically open chain ketomethylene compounds. Also preferred are yellow couplers such as described in, for example, European Patent Application Nos. 482,552; 510,535; 524,540, 543,367, and U.S. Pat. No. 5,238,803. For improved color reproduction, couplers which give yellow dyes that cut off sharply on the long wavelength side are particularly preferred (for example, see U.S. Pat. No. 5,360,713).

Typical preferred yellow couplers are represented by the following formulas:

YELLOW-1

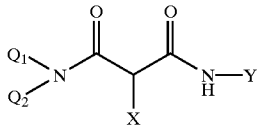

YELLOW-2

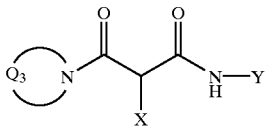

YELLOW-3

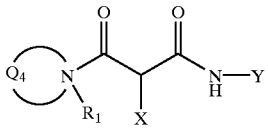

YELLOW-4

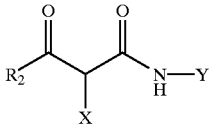

wherein $R_1$, $R_2$, $Q_1$ and $Q_2$ each represents a substituent, X is hydrogen or a coupling-off group, Y represents an aryl group or a heterocyclic group, $Q_3$ represents an organic residue required to form a nitrogen-containing heterocyclic group together with the>N—; and $Q_4$ represents nonmetallic atoms necessary to from a 3- to 5-membered hydrocarbon ring or a 3- to 5-membered heterocyclic ring which contains at least one hetero atom selected from N, O, S, and P in the ring. Particularly preferred is when $Q_1$ and $Q_2$ each represent an alkyl group, an aryl group, or a heterocyclic group, and $R_2$ represents an aryl or tertiary alkyl group.

Preferred yellow couplers can be of the following general structures:

Y-1

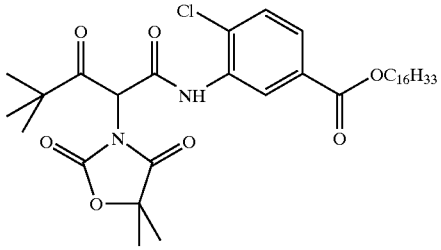

Y-2

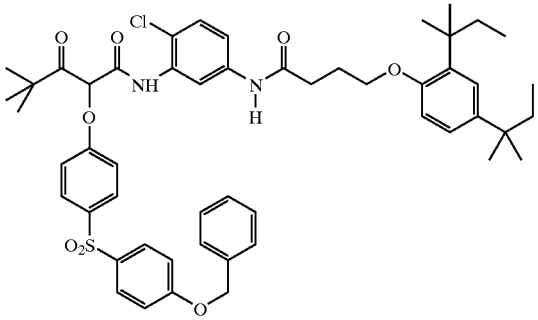

Y-3

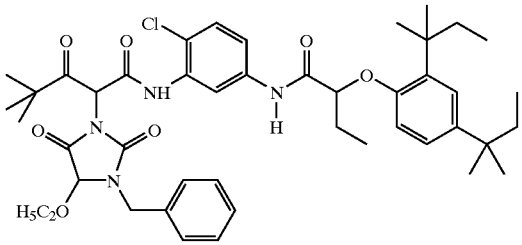

Y-4

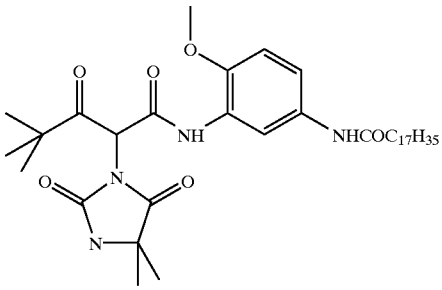

Y-5

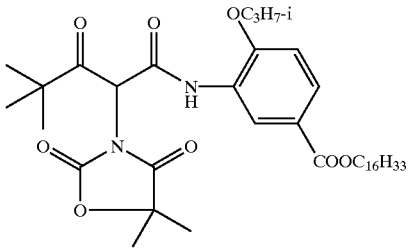

-continued

Y-6

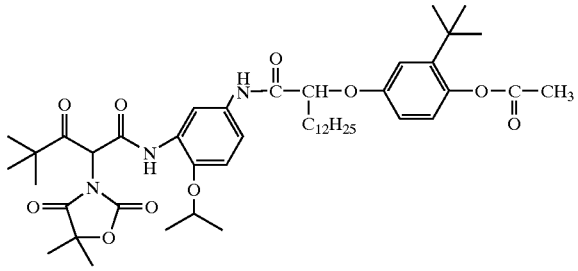

The list of couplers above should not be construded as an exhaustive listing of dye forming couplers that are useful in this invention. Furthermore it should be noted that the use of various stabilizers, scavengers, ultraviolet stablizers, surfactants, imaging recording materials, dopants, interlayers, ballasting materials may be obtained form the above mention *Research Disclosure*.

EXAMPLE

The imaging element used in this invention consist of a typical color emulsion that forms cyan, magenta and yellow dye as the top side emulsion, a translucent polymer sheet having a spectral transmission of between 40 and 60 percent and a light sensitive emulsion on the backside in which the dye forming coupler is in a different light sensitive layer than the top side. An example of the emulsion used on the top side of this example is described in *Research Disclosure*, September 1994, Item 36544, Section I, published by Kenneth Mason Publications, Ltd., Dudley Annex, 12a North Street, Emsworth, Hampshire PO10 7DQ, ENGLAND. The below in diagram represents a cross section of one of the preferred embodiments of this invention:

Example 1

| |
|---|
| L1: Size Overcoat |
| L2: Red-sensitized |
| cyan dye image-forming silver halide emulsion unit |
| L3: Interlayer |
| L4: Green-sensitized |
| magenta dye image-forming silver halide emulsion unit |
| L5: Interlayer |
| L6: Blue-sensitized |
| yellow dye image-forming silver halide emulsion unit |
| L7: Gel Sub |
| L8: Primer |
| L9: Clear Polyester |
| L10: 4% TiO2 in Polyester |
| L11: Voided Polyester |
| L12: Clear Polyester |
| L13: Primer |
| L14: Antistat |
| L15: Red-sensitized |
| magenta image-forming silver halide emulsion unit |
| L16: Interlayer |
| L17: Green-sensitized |
| Yellow dye image-forming silver halide emulsion unit |
| L18: Interlayer |
| L19: Blue-sensitized |
| Cyan dye image-forming silver halide emulsion unit |
| L20: Size Overcoat |

The translucent sheet (L7–L14) of this imaging element is describe as follows:

L1: Top Layer (gel sub and primer layer):

The polyester sheet (L9–L12) used in this example was a biaxially oriented, two side subbed by first applying a latex primer (L8) terpolymer of acrylonitrile, vinylidene chloride and acrylic acid to both sides of the support surface before drafting and tentering so that the final coating weight was about 92 mg/m$^2$. The primer layer was dried at 100° C. An upper gel sub (L7) was coated on top of the primer layer side of the transparent polymer sheet. The materials were prepared as per example 1 and 3 of U.S. Pat. No. 5,876,910. On the bottom primer layer(L13- same as L8) a coating of an antistat formula (L14) was coated on one side of the subbed, polyester support to give a total dry coating weight of about 1 mg/m$^2$. The antistat formula consisted of the following components prepared at 0.091% total solids.

| Material | % Solids | Wt. % |
|---|---|---|
| Terpolymer Latex* | 30% | 0.098% |
| Triton X-100 (Rohm and Haas), | 10% solids | 0.212% |
| Vanadium Pentoxide Dispersoin | 5% | 0.6% |
| Demineralized Water | | Balance |

*Terpolymer manufactured by Eastman Kodak (described under subbing)

The antistat coating was coated with a protective layer to give a dry coating weight of about 1000 mg/m$^2$.

Coextruded Polyester sheet (L9–L12):

A layer of clear polyester (L9) with a layer thickness of 1.0 micrometer.

A layer of white pigmented polyester(L10). To this layer pigment blue 60 and Hostalux KS (Ciba-Geigy) optical brightener were added to offset the yellowness of the gelatin based emulsion. The 0.30% by weight of pigment blue 60, 0.12% by weight of optical brightener was added to the voided polyester layer and 4% by weight of DuPont R104 rutile $TiO_2$. The layer thickness was 8 micrometers A layer of mircovoided polyester (polyethylene terephthalate)(L11) comprising polyester and microbeads with a layer thickness of 25 micrometer and a percent voiding of 50%. The voiding agent was a cross-linked microbead of polystyrene with divinylbenzene in the amount of 50% by weight of said layer. The mean particle size of the microbead was between 1 to 2 micrometer and were coated with a slip agent of colloidal alumina.

Bottom Layer

The bottom layer (L12) of the coextruded support was a solid layer of polyester that was 100 micrometer thick. The polyester has an intrinsic viscosity of about 0.68 cp.

The polyester layers were coextruded through a standard three slot coat hanger die at 265° C. onto a chill roll controlled at a temperature between 50–60° C. The four layer film was stretched biaxially using a standard laboratory film stretching unit at a temperature of 105° C.

The preparation steps for the cross-linked microbeads used to void the middle layer of the coextruded support were as follows:

(1) The microbeads were prepared by conventional aqueous suspension polymerization to give nearly mono-disperse bead diameters from 2 to 20 micrometer and at levels of cross-linking from 5 mol % to 30 mol %.

(2) After separation and drying, the microbeads were compounded on conventional twin-screw extrusion equipment into the polyester at level of 25% by weight and pelletized to form a concentrate, suitable for let-down to lower loadings.

(3) The microbead concentrate pellets were mixed with virgin pellets and dried using standard conditions for polyethylene terephthalate, 170–180.degree. C. convection with desiccated air for between 4–6 hours.

Below the conductive layer(L14) is a second light sensitive silver halide emulsion (L15–L20). While this emulsion is similar to the top light sensitive layer, the couplers in the bottom light sensitive emulsion are combined with an emulsion sensitized to a different color. Any coupler know in the art may be used. As provided above Table 1 provides additional details of the various combination of dye forming coupler in the various top and bottom light sensitive layer and the resulting colors by reflected light viewing or by transmitted viewing. It should be noted that Table 1 is not an exhaustive list of the various coupler combination that may be useful.

Example 2

This example is the same as example 1 except L20 contains a quantity of anithalation material. Typical materials that are useful for antihalation are solid particle dyes and gray silver in a gelatin binder. The antihalation layer is typically a layer of gelatin with "black" or exposed silver. The purpose of such a layer is to provide improved sharpness and to prevent the reexposure of the silver grains once the light has passed through the emulsion. In a conventional photographic print in which the light sensitive emulsion is on top of the support, a considerable amount of light may be diffusely transmitted by the emulsion and strike the back surface of the support. This light is partially or totally reflected back to the emulsion and reexposed it at a considerable distance from the initial point of entry. This effect is called halation because it causes the appearance of halos around images of bright objects. Further, a transparent support also may pipe light. Halation can be greatly reduced or eliminated by absorbing the light transmitted by the emulsion or piped by the support. Three methods of providing halation protection are (1) coating an antihalation undercoat which is either dye gelatin or gelatin containing gray silver on the bottom most layer of the imaging member, (2) coating the emulsion on a support that contains either dye or pigments, and (3) coating the emulsion on a transparent support that has a dye to pigment a layer coated on the top. The absorbing material contained in the antihalation is removed by processing chemicals when the photographic element is processed. The dye or pigment within the support is permanent and generally is not preferred for the instant invention. It is preferred that the antihalation layer be formed of gray silver which is coated on the bottom most side furthest from the viewer and removed during processing. By coating the antihalation on the bottom most part of the backside of the transparent polymer sheet, the antihalation layer is easily removed during processing, as well as allowing exposure of the material from only one side. It has also been found that small quantities of $TiO_2$ or white pigment added to the non-light sensitive layers such as the ultraviolet layer furthest from the transparent polymer sheet or size overcoat layer of a typical emulsion provide improved exposure speed and sharpness. For the purpose of this invention gray silver was added to the bottom most SOC (size overcoat) L20. During processing the gray silver is removed from the imaging element.

An image was exposed onto the above described examples using a digitized image file and a collimated beam of light using a red, green and blue form of actinic radiation. The collimated beam exposed the top emulsion layer, passed through the translucent sheet and exposed the bottom light sensitive layers. The photographic emulsions were developed in standard RA4 chemistry. The developed image was then placed in a light box with a clear top cover and a varying intensity light source that projected light through the imaging element.

The use of different dye forming couplers in the same light sensitive emulsion on the top and on the bottom when exposed and developed provides an additive color effective when light is transmitted through the imaging element. When viewed in reflected light, only the top emulsion coupler formed dyes are seen. Therefore, by switching between reflected and transmitted light illumination, the observed color of the imaging element is changed.

Example 3

| |
|---|
| L1: Size Overcoat |
| L2: Red-sensitized |
| Magenta dye image-forming silver halide emulsion unit |
| L3: Interlayer |
| L4: Green-sensitized |
| yellow dye image-forming silver halide emulsion unit |
| L5: Interlayer |
| L6: Blue-sensitized |
| Cyan dye image-forming silver halide emulsion unit |
| L7: Low Density Polyethylene + Blue tint |
| L8: 4% $TiO_2$ in Polypropylene + Optical Brightener |
| L9: Voided Polypropylene |
| L10: Clear Polypropylene |
| L11: Clear Polypropylene |
| L12: Clear tie layer of low density polyethylene |
| L13: Clear polyester |
| L14: Primer |
| L15: antistat |
| L17: Gel sub |
| L18: Red-sensitized |
| Yellow image-forming silver halide emulsion unit |
| L19: Interlayer |
| L20: Green-sensitized |
| Cyan dye image-forming silver halide emulsion unit |
| L21: Interlayer |
| L22: Blue-sensitized |
| Magenta dye image-forming silver halide emulsion unit |
| L23: Size Overcoat + antihalation dye |

Example 3 depictrd above, comprises a top silver halide emulsion similar to that described in example 1 and is represented as L1–L6. Layers L7–L14 is a base substrate which is a 5 layer voided biaxially oriented polyolefin sheet (L7–L11) that is approximately 1.4 mil thick. This sheet is adhered to a polyester base using a metallocene catalyzed ethylene plastomer (SLP 9088) manufactured by Exxon Chemical Corp. (L12). The clear polyester sheet with primer, gel sub and antistat coating are shown as L14–L18. A backside photographic emulsion and it interlayers and bottom most gel sub with antihalation is shown as L18–L23. It should be noted that the red sensitive layer of the top photographic emulsion contains a cyan dye forming coupler and the red layer of the bottom photographic emulsion L18 contains a different dye forming coupler. In this example it is a magenta dye forming coupler. Not shown in this example, it is also possible to use a yellowing forming coupler inplace of the magenta dye forming coupler. The green light sensitive layer L2 of the top emulsion also has a different coupler than the corresponding green sensitive layer on the backside (L20). This is also true of the top side blue sensitive layer (L6) and the backside blue sensitive layer (L22). It is also possible to create examples of any combination of top and backside dye forming coupler to produce a variety of colors in the various light sensitive layers. The important point is that by reflected light only the top dye forming couplers are observed while with transmitted light the color observed is the combination of the top and backside dye forming coupler.

Base Substrate (L7–L11)

A biaxially oriented sheet comprises composite sheet consisting of 5 layers identified as L7, L8, L9, L10, and L11. L7 is the thin-colored layer on the outside (top) of the base sunstrate to which the photosensitive silver halide layer was attached. L8 is the layer to which optical brightener and 4% $TiO_2$ was added. The optical brightener used was Hostalux KS manufactured by Ciba-Geigy. The rutile $TiO_2$ used was DuPont R104 (a 0.22 .mu.m particle size $TiO_2$). Table 3 below lists the characteristics of the layers of the top biaxially oriented sheet and the adhering tie layer L12 used in this example.

TABLE 3

| Layer | Material | Thickness, .mu. |
|---|---|---|
| L7 | LD Polyethylene + color concentrate | 0.75 |
| L8 | Polypropylene + $TiO_2$ + OB | 4.32 |
| L9 | Voided Polypropylene | 24.9 |
| L10 | Polypropylene | 4.32 |
| L11 | Polypropylene | 0.762 |
| L12 | LD Polyethylene Tie Layer | 11.4 |

The L9 layer for the biaxially oriented sheet is microvoided and further described in Table 4 where the refractive index and geometrical thickness is shown for measurements made along a single slice through the L3 layer. The measurements do not imply continuous layers, as a slice along another location would yield different but approximately the same thickness. The areas with a refractive index of 1.0 are voids that are filled with air and the remaining layers are polypropylene.

TABLE 4

| Sublayer of L9 | Refractive Index | Thickness, .mu.m |
|---|---|---|
| 1 | 1.49 | 2.54 |
| 2 | 1 | 1.527 |
| 3 | 1.49 | 2.79 |
| 4 | 1 | 1.016 |
| 5 | 1.49 | 1.778 |
| 6 | 1 | 1.016 |
| 7 | 1.49 | 2.286 |
| 8 | 1 | 1.016 |
| 9 | 1.49 | 2.032 |
| 10 | 1 | 0.762 |
| 11 | 1.49 | 2.032 |
| 12 | 1 | 1.016 |
| 13 | 1.49 | 1.778 |
| 14 | 1 | 1.016 |
| 15 | 1.49 | 2.286 |

L12 is a melt extrudable 14 melt index low density polyethylene. The polymer is melted at 600F and extrusion coated between the biaxially oriented sheet and and the polyester sheet into a pressure nip. The top sheet used in this example was coextruded and biaxially oriented. The top sheet was melt extrusion laminated to the paper base using an metallocene catalyzed ethylene plastomer (SLP 9088) manufactured by Exxon Chemical Corp. The metallocene catalyzed ethylene plastomer had a density of 0.900 g/cc and a melt index of 14.0.

Photographic Grade Polyester Base with Primer,Gel sub and Antistat (L13–L17)

A polyethylene terephthalate sheet base 125 .mu.m thick that was transparent and has primer and gelatin sub on the top sides of the base and a primer and antistat on the bottom side as described in example 1. Additional a gel sub layer is coated on the bottom antistat to improve emulsion adhesion and wettability for the bottom side emulsion. Each side of the laminated substrate is cornea treated just prior the application of the light sensitive emulsions to further enhance adhesion and wettability.

An example of the emulsion used on the top side of this example is described in *Research Disclosure*, September 1994, Item 36544, Section I, published by Kenneth Mason Publications, Ltd., Dudley Annex, 12a North Street, Emsworth, Hampshire PO10 7DQ, ENGLAND.

The bottom most emulsion contained a quantity of anithalation material. Typical materials that are useful for antihalation are solid particle dyes, gray silver in a gelatin binder. The antihalation layer is typically a layer of gelatin with "black" or exposed silver. The purpose of such a layer is to provide improved sharpness and to prevent the reexposure of the silver grains once the light has passes through the emulsion. In a conventional photographic print in which the light sensitive emulsion is on top of the support, a considerable amount of light may be diffusely transmitted by the emulsion and strike the back surface of the support. This light is partially or totally reflected back to the emulsion and reexposed at a considerable distance from the initial point of entry. This effect is called halation because it causes the appearance of halos around images of bright objects. Further, a transparent support also may pipe light. Halation can be greatly reduced or eliminated by absorbing the light transmitted by the emulsion or piped by the support. Three methods of providing halation protection are (1) coating an antihalation undercoat which is either dye gelatin or gelatin containing gray silver on the bottom most layer of the imaging member, (2) coating the emulsion on a support that contains either dye or pigments, and (3) coating the emulsion on a transparent support that has a dye to pigment a layer coated on the top as illustrated in the Example 3. The absorbing material contained in the antihalation is removed by processing chemicals when the photographic element is processed. The dye or pigment within the support is permanent and generally is not preferred for the instant invention. It is preferred that the antihalation layer be formed of gray silver which is coated on the bottom most side furthest from the viewer and removed during processing. By coating the antihalation on the bottom most part of the backside of the transparent polymer sheet, the antihalation layer is easily removed during processing, as well as allowing exposure of the material from only one side. It has also been found that small quantities of $TiO_2$ or white pigment added to the non-light sensitive layers such as the ultraviolet layer furthest from the transparent polymer sheet or size overcoat layer of a typical emulsion provide improved exposure speed and sharpness. For the purpose of this invention gray silver was added to the bottom most SOC (size overcoat). During processing the gray silver is removed from the imaging element.

An image was exposed onto this example using a digital file and a collimated beam of light using a red, green and blue form of actinic radiation. The collimated beam exposed the top emulsion layer, passed through the translucent sheet and exposed the bottom light sensitive layers. The imaging element was developed in standard RA4 chemistry. The developed image was then placed in a light box with a top clear cover and a varying intensity light source that projected light through the imaging element. The use of complimentary couplers in the same light sensitive emulsion on the top and on the bottom when exposed and developed provides an additive color effective when light is transmitted through the imaging element. When viewed in reflected light, only the top emulsion coupler are seen. Therefore by switching between reflected and transmitted light illumination, the observed color of the imaging element is changed.

Example 4

Using a translucent sheet as describe in examples 1 or 2 or similar type translucent sheet having a spectral transmission of between 40 and 60 percent, as well as light sensitive silver halide emulsions on the top side and bottom side, a further example of a switchable photographic display may be made by incorporating a speed differential between the top side light sensitive emulsion and the backside light sensitive emulsion. Since the support substrate sheet absorbs some light, the light intensity reaching the top side emulsion is different than the light intensity reaching the backside. In order to achieve similar density and photographic response, the top side light sensitive emulsion needs to be slower than that of the backside emulsion. This may be adjusted by the amount of silver coverage, the addition of absorber dye or even silver grain morphology.

Control

The control example was made similar to example 1; expect the dye forming coupler in the top red sensitive layer was the same cyan coupler as in the bottom red sensitive layer. Both the top and bottom side green light sensitive and blue light sensitive layer had the same dye forming coupler in their respective layers. When this example is imaged and developed as described above and is viewed in reflected light and then in transmitted light, the same color is observed.

TABLE 6

| Example | Top Side Red Sensitive Layer W Dye Coupler | Bottom Side Red Sensitive Layer w Dye Coupler | Color Observed by Reflection | Color Observed by Transmission |
|---|---|---|---|---|
| Control | Cyan | Cyan | Cyan | Cyan |
| 1 | Cyan | Magenta | Cyan | Blue |
| 2 | Cyan | Magenta | Cyan | Blue |
| 3 | Magenta | Yellow | Magenta | Orange |
| 4 | Cyan | Magenta | Cyan | Blue |

Table 6 only shows one light sensitive layer on the top and bottom of the respective examples and the color observed after imaging and development. Since the control sample has the same dye forming couple in both the top and bottom red light sensitive layer, the same color is observed in either reflection or transmission. Examples 1–4 have different dye forming couplers in the red light sensitive layer on the top and on the bottom. In example 1 the red light forms a cyan dye while the same red light forms magenta dye on the backside. When this example is observed in reflected light only, the dye in the top photographic emulsion is seen, but when the back light is turned on the image is viewed in transmission and the color observed is a combination of the top layer dye and the bottom layer dye. In example 1 the blue is observed in transmission. Example 3 shows that when magenta and yellow are combined in transmission, that orange is observed. While examples 2 and 4 had the same dye coupler combinations as example 1, the use of the antihalation layer in example 2 was useful in improving the overall image sharpness and in example 4 in which the photographic speed was difference between the top and backside photographic emulsion was useful in achieving and controlling the dye density between the top and backside image layers. This is useful in controlling the dye density whether viewed by transmitted or reflected light.

Dye Forming Coupler used in Examples

Cyan Dye Forming Coupler was Cyan2 as noted above

Yellow Dye Forming Coupler was Y-1 as noted above

Magenta Dye Forming Coupler was M-2 as noted above

The invention has been described in detail with particular reference to certain preferred embodiments thereof, but it will be understood that variations and modifications can be effected within the spirit and scope of the invention.

What is claimed is:

1. An imaging element comprising a translucent sheet, and at least three photosensitive dye forming coupler containing layers on the face side of said sheet, wherein said at least three photosensitive forming coupler containing layers comprise a cyan dye forming layer comprising a cyan dye forming coupler in combination with a red sensitized photosensitive emulsion, a yellow dye forming layer comprising a yellow dye forming coupler in combination with a blue light sensitive photosensitive emulsion, a magenta dye forming layer comprising a magenta dye forming coupler and a green light sensitive photosensitive emulsion, and on the back side of said translucent polymer sheet at least one dye forming coupler comprising magenta dye forming coupler, cyan dye forming coupler, or yellow dye forming coupler in combination with a light sensitive silver halide emulsion sensitive to a different wavelength of visible light than it was in combination with on the face side.

2. An imaging element of claim 1 wherein said back side comprises a layer comprising cyan dye forming coupler in combination with an emulsion sensitive to blue light.

3. An imaging element of claim 1 wherein said back side comprises a layer comprising cyan dye forming coupler in combination with an emulsion sensitive to green light.

4. An imaging element of claim 1 wherein said back side comprises a layer comprising magenta dye forming coupler in combination with an emulsion sensitive to blue light.

5. An imaging element of claim 1 wherein said back side comprises a layer comprising magenta dye forming coupler in combination with an emulsion sensitive to red light.

6. An imaging element of claim 1 wherein said back side comprises a layer comprising yellow dye forming coupler in combination with an emulsion sensitive to green light.

7. An imaging element of claim 1 wherein said back side comprises a layer comprising yellow dye forming coupler in combination with an emulsion sensitive to red light.

8. An imaging element of claim 1 wherein said back side comprises each of the three couplers on the face side in combination with a sensitized emulsion of a different color sensitivity than each of the three couplers was in combination with on the face side.

9. The imaging element of claim 1 wherein said translucent sheet comprises a translucent polymer sheet having a spectral transmission of between 35 and 65 percent.

10. The imaging element of claim 1 wherein said translucent sheet comprises a translucent polymer sheet having a spectral transmission of between 40 and 60 percent.

11. The imaging element of claim 1 wherein said translucent sheet comprises a translucent cellulose fiber.

12. The imaging element of claim 1 wherein said translucent sheet comprises a coextruded sheet of polyester.

13. The imaging element of claim 1 wherein said translucent sheet comprises laminated biaxially oriented polymer.

14. The imaging element of claim 1 wherein said translucent sheet comprises an adhesion promoting layer.

15. The imaging element of claim 1 wherein said translucent sheet comprises tinting aids and or optical brighteners.

16. The imaging element of claim 1 wherein said translucent sheet comprises voids.

17. The imaging element of claim 1 wherein said translucent sheet comprises white pigment.

18. The imaging element of claim 1 wherein said translucent sheet comprises at least one layer comprising voids and at least one layer comprising white pigment.

19. The imaging element of claim 1 wherein said translucent sheet further comprises an antistat.

20. The method of creating switchable photographic image comprising providing an imaging element comprising a translucent sheet, and at least three photosensitive dye forming coupler containing layers on the face side of said sheet, wherein said at least three photosensitive forming coupler containing layers comprise a cyan dye forming layer comprising a cyan dye forming coupler in combination with a red sensitized photosensitive emulsion, a yellow dye forming layer comprising a yellow dye forming coupler in combination with a blue light sensitive photosensitive emulsion, a magenta dye forming layer comprising a magenta dye forming coupler and a green light sensitive photosensitive emulsion, and on the back side of said translucent polymer sheet at least one dye forming coupler comprising magenta dye forming coupler, cyan dye forming coupler, or yellow dye forming coupler in combination with a light sensitive silver halide emulsion sensitive to a different wavelength of visible light than it was in combination with on the face side imaging said member, developing said image, placing the developed image at spaced separation from a light source, controlling said light source such that its intensity varies.

21. The method of claim 20 wherein said imaging member comprises a layer comprising cyan dye forming coupler in combination with an emulsion sensitive to blue light.

22. The method of claim 20 wherein said imaging member comprises a layer comprising cyan dye forming coupler in combination with an emulsion sensitive to green light.

23. The method of claim 20 wherein said imaging member comprises a layer comprising magenta dye forming coupler in combination with an emulsion sensitive to red light.

24. The method of claim 20 wherein said imaging member comprises a layer comprising yellow dye forming coupler in combination with an emulsion sensitive to green light.

25. The method of claim 20 wherein said imaging member comprises a layer comprising yellow dye forming coupler in combination with an emulsion sensitive to red light.

26. The method of claim 20 wherein said imaging member comprises each of the three couplers on the face side in combination with a sensitized emulsion of a different color sensitivity than each of the three couplers was in combination with on the face side.

27. The method of claim 20 wherein said translucent sheet comprises a translucent polymer sheet having a spectral transmission of between 40 and 60 percent.

28. The method of claim 20 wherein said translucent sheet comprises said translucent sheet comprises voids.

29. The method of claim 20 wherein said translucent sheet comprises an antistat.

* * * * *